US006722757B2

(12) United States Patent
Saito

(10) Patent No.: US 6,722,757 B2
(45) Date of Patent: Apr. 20, 2004

(54) EJECTION RECOVERY DEVICE IN INK JET PRINTING APPARATUS, AND INK JET PRINTING APPARATUS

(75) Inventor: Hiroyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/235,759

(22) Filed: Sep. 6, 2002

(65) Prior Publication Data

US 2003/0063150 A1 Apr. 3, 2003

(30) Foreign Application Priority Data

Sep. 7, 2001 (JP) ..... 2001-272802
Sep. 7, 2001 (JP) ..... 2001-272803

(51) Int. Cl.[7] ..... B41J 2/165
(52) U.S. Cl. ..... 347/29; 347/30
(58) Field of Search ..... 347/29, 30, 31, 347/32, 23, 92

(56) References Cited

U.S. PATENT DOCUMENTS 5,245,362 A 9/1993 Iwata et al. ..... 347/29
6,109,725 A 8/2000 Saikawa et al. ..... 347/33
6,364,449 B1 * 4/2002 Takahashi et al. ..... 347/30
6,467,872 B1 * 10/2002 Yamada et al. ..... 347/30
6,471,330 B1 * 10/2002 Umeda et al. ..... 347/29
6,481,826 B1 * 11/2002 Hara et al. ..... 347/29
6,508,533 B2 * 1/2003 Tsujimoto et al. ..... 347/30
6,565,188 B1 5/2003 Saito ..... 347/33

FOREIGN PATENT DOCUMENTS

EP 0 317 267 A2 * 5/1989
EP 0 435 666 A2 * 7/1991
EP 0 933 215 A2 * 8/1999

OTHER PUBLICATIONS

U.S. application No. 09/679,605, filed Oct. 5, 2000, Patented, Pat. No. 6,565,188.
U.S. application No. 10/234,157, filed Sep. 5, 2002, pending.
U.S. applciation No. 09/902,758, filed Jul. 12, 2001, allowed, patent # not assigned yet.

* cited by examiner

*Primary Examiner*—Shih-Wen Hsieh
(74) *Attorney, Agent, or Firm*—Fitzpatrick, Cella, Harper & Scinto

(57) ABSTRACT

An inexpensive ejection recovery device for an ink jet printing apparatus is provided which can simultaneously perform suction-based recovery operations using a single cap while preventing different kinds of ink from getting mixed in the print head. For this purpose, the ejection recovery device of the invention has a cap to cover a plurality of ejection ports formed in the print head and a pump connected to an exhaust port formed in the cap to generate a predetermined pressure. The cap is formed with a plurality of suction ports and with a plurality of paths connecting each of the suction ports and the exhaust port. Flow resistances of the paths from each of the suction ports to the exhaust port are set equal.

25 Claims, 21 Drawing Sheets

EJECTION RECOVERY DEVICE IN INK JET PRINTING APPARATUS, AND INK JET PRINTING APPARATUS

This application is based on Japanese Patent Application Nos. 2001-272802 and 2001-272803, both filed Sep. 7, 2001, the contents of which are incorporated hereinto by reference.

BACKGROUND OF THE INVENTION

1. Field of the Invention

The present invention relates to an ink jet printing apparatus for printing an image on a print medium by ejecting ink from a print head and to an ejection recovery device used in the ink jet printing apparatus to keep ink ejection from nozzles of the print head in good condition.

The present invention can be applied not only to general printing apparatus but also to copying machines, facsimile machines with a communication function, word processors with a printing unit and even industrial printing apparatus combined with a variety of processors.

2. Description of the Related Art

Printing apparatus with functions of a printer, a copying machine and a facsimile, composite type electronic apparatus including computers and word processors, and printing apparatus used as an output device for workstations are designed to print an image on a print medium such as paper and plastic thin films.

Of these printing apparatus, an ink jet printing apparatus, which forms an image by ejecting ink onto a print medium from a print head as a printing means, has the following advantages. That is, the print head can easily be reduced in size, which in turn enables high-speed printing of an image with an enhanced resolution; and the ink jet printing apparatus can print on plain paper without requiring a special treatment of the print medium, thus reducing the running cost. Another advantage is that since the ink jet printing apparatus employs a non-impact system, noise is low. Further, multiple ink colors can be used to form a full color image with ease. In a line type ink jet printing apparatus in which a large number of nozzles are arrayed in a direction of width of the print medium, still faster printing is possible.

Further, in an ink jet printing means (print head) employing a so-called bubble jet (tradename) system that uses a thermal energy to form bubbles in ink and ejects ink by an energy generated by the bubbles, a highly dense nozzle arrangement can be realized which comprises electrothermal transducers, electrodes, liquid paths and a top plate, all formed on a substrate by a semiconductor manufacturing process including etching, vapor deposition and sputtering. The high-density nozzle arrangement allows for a further reduction in size.

The ink jet printing apparatus, however, has a problem that an ingress of air into ink ejection nozzles may dry ink, increasing an ink viscosity and making ink ejection from the nozzles impossible. A known technique to recover the ability of the print head to eject ink is a method that draws out the ink not contributing to the image making from the tips of the nozzles by suction (recovery by suction).

A means for realizing this recovery by suction (suction-based recovery means) consists generally of a cap that can cover the nozzles of the print head air-tightly and a negative pressure generating means that can generate a negative pressure in the cap.

In his specification, the word "nozzle" is meant to include a plurality of divided liquid paths for ejecting ink supplied to a common liquid chamber in the print head and ink ejection ports or openings formed at one end of the liquid paths. The word "ink" is meant to include visually recognizable color liquids and a print quality enhancement liquid that improves a print quality of that portion of a print medium which is applied with this enhancement liquid.

FIG. 17 shows a recovery device conventionally used in the ink jet printing apparatus. The recovery device shown here includes a cap M5001 arranged in a path on which the print head not shown is moved, a pump M5100 as a negative pressure generating means communicating with this cap, and wiper blades M5011, M5012-1, M5012-2 for removing ink from a nozzle forming surface of the print head.

When a PG motor E0003 rotates in a forward direction, the cap M5001 comes into hermetic contact with the ejection port forming surface of the print head to enclose the nozzles of the print head (capping). Next, when the PG motor E0003 rotates in a backward direction to rotate the pump in a reverse direction, a roller is rotated while in pressure contact with the pump tube, squeezing the pump tube to generate a negative pressure.

This negative pressure acts on the nozzles of the print head through exhaust port M5001*a* formed in the cap to discharge ink from the cap M5001 and a plurality of suction ports M5005*a*, M5005*b*, M5005*c* formed in a flow path forming member M5005 that covers the exhaust port M5001*a*. As a result, viscous ink and foam not suited for printing are drawn out of the ejection ports of the print head and further drawn into the suction ports M5005*a*, M5005*b*, M5005*c* provided in the cap M5001 through an ink absorber M5002 for discharging.

Then, the PG motor is driven in the forward direction to cause the cap to part from the ink ejection port forming surface of the print head (decapping), ending a series of suction-based recovery operations.

As shown in FIG. 17 through FIG. 20, the multiple suction ports M5005*a*, M5005*b*, M5005*c* are formed at a plurality of dispersed locations in the flow path forming member M5005 so that the suction ports M5005*a*, M5005*b*, M5005*c* are arranged one between each of different color ink nozzle columns. This arrangement is made to prevent different kinds of ink that have flowed out from different color ink nozzle columns of the print head from crossing other nozzle columns.

The conventional ink ejection recovery device described above, however, still has the following problems that need to be addressed.

A color printing capability and enhanced print quality and resolution required of the ink jet printing apparatus of recent years have increased the number of ink ejection nozzles of the print head and the number of ink colors and also reduced the size of ejected ink droplets considerably. It is therefore necessary to take sufficient care in handling the ink droplets ejected from the print head. For example, if a color ink enters nozzles of different color, these different colors will become mixed (color mixing), failing to produce a normal color printed image. Some countermeasures need to be taken to void this phenomenon.

This color mixing phenomenon easily occurs during the suction-based recovering operation on the print head. Thus, in the conventional technique, suction ports are provided between nozzle columns of different color inks to prevent color inks from getting into the nozzles assigned with different color inks, as described above. This technique has been confirmed to have an effect of alleviating the color mixing but more efforts are needed for minimizing this phenomenon.

To meet this requirement, various methods have been tried. For example, the ink suction is performed separately on nozzle columns of different ink colors by using suction caps dedicated for each color, or a single suction cap is used to draw out ink successively from nozzle columns of different colors, one color at a time. These methods, however, complicate the printing apparatus, resulting in increases in size, cost and suction-based recovery operation time.

In the method that performs the ink suction operations successively with a single cap, the ink staying near the nozzles of the print head is discharged after the suction-based recovery operation is finished until the printing is started, in order to clear the nozzles of unintended or unassigned color inks before starting the printing operation. In this method, too, there is a tendency that as the number of nozzles increases, the amount of ink discharged also increases. This in turn increases a consumption of ink.

SUMMARY OF THE INVENTION

The present invention has been accomplished with a view to overcoming the problems of the conventional techniques mentioned above. It is therefore an object of the present invention to provide an inexpensive ejection recovery device capable of simultaneously and efficiently performing suction-based recovery operations using a single cap while preventing different kinds of ink from getting mixed. Another object of the present invention is to provide an ink jet printing apparatus having such an ejection recovery device.

To achieve the above objective, the present invention has the following construction.

According to one aspect, the present invention provides an ejection recovery device in an ink jet printing apparatus comprising: a cap movable toward and away from a print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a plurality of suction ports are formed in the cap and a plurality of paths connecting the plurality of suction ports and the exhaust port have their flow resistances set almost equal.

The paths formed in the cap may be set so that flow speeds of ink passing through the plurality of suction ports are almost equal.

Further, it is also possible to set lengths of the paths almost equal or set cross-sectional areas of the path almost equal.

According to another aspect, the present invention provides an ejection recovery device comprising: a cap movable toward and away from a print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a flow path forming member formed with a plurality of suction ports is fixed to the cap by a predetermined fixing means, the flow path forming member is formed with a plurality of paths connecting the plurality of suction ports and the exhaust port, and the plurality of paths from the suction ports to the exhaust port have almost equal flow resistances.

The flow path forming member may be elastically fixed to an exhaust port forming surface of the cap by the fixing means integrally provided to the cap and having an elasticity. The flow path forming member may form paths in the cap by being combined with the exhaust port forming surface of the cap with which the flow path forming member is brought into intimate contact by an elastic force of the fixing means.

The print head may have ejection portions, one for each kind of ink, each of the ejection portions having at least one column of ejection ports. An arrangement may be made in which when the cap covers the print head, the suction ports of the cap are located near the ejection port columns. For example, if the print head has a plurality of columns of ejection ports for each kind of ink, the suction ports of the cap may each be located between the ejection port columns when the cap covers the plurality of ejection port columns.

According to still another aspect, the present invention provides an ink jet printing apparatus comprising: a printing means having a print head formed with a plurality of ejection ports for ejecting ink; and an ejection recovery device that performs an ejection recovery operation to keep an ink ejection performance of the ejection ports in good condition; wherein the ejection recovery device includes: a cap movable toward and away from the print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a plurality of suction ports are formed in the cap and a plurality of paths connecting the plurality of suction ports and the exhaust port have almost equal flow resistances.

According to a further aspect, the present invention provides an ejection recovery device in an ink jet printing apparatus comprising: a cap movable toward and away from a print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a fixing means is used to fix in the cap a flow path forming member formed with a plurality of suction ports and with a plurality of paths for communicating the plurality of suction ports to the exhaust port.

According to a further aspect, the present invention provides an ink jet printing apparatus comprising: a cap movable toward and away from a print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a fixing means is used to fix in the cap a flow path forming member formed with a plurality of suction ports and with a plurality of paths for communicating the plurality of suction ports to the exhaust port.

According to a further aspect, the present invention provides an ejection recovery device in an ink jet printing apparatus comprising: a cap movable toward and away from a print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a flow path forming member having the suction ports is provided in the cap to form a plurality of paths connecting the suction ports and the exhaust port; wherein the flow path forming member is integrally formed with an engagement means for engaging the ink absorber with the flow path forming member so that the ink absorber capable of absorbing ink can cover the suction ports.

If the print head has ejection portions, one for each kind of ink, each of the ejection portions having at least one column of ejection ports, it is possible to provide a plurality of the suction ports, one for each ejection portion, in the flow path forming member.

The engagement means is preferably arranged to avoid an interference with the ejection ports of the print head. For this purpose, the engagement means may be provided at a position not opposing the ejection ports of the print head.

Further, the engagement means may be a bent retainer portion protruding from a suction port forming surface. The retainer portion is inserted through an insertion hole formed in the ink absorber, and one end portion of the retainer portion holds the ink absorber between it and the flow path forming member. For example, the engagement means may comprise a riser portion rising from one surface of the flow path forming member and a clamp portion integrally formed at one end of the riser portion and facing the one surface of the flow path forming member.

Further, when the suction ports of the flow path forming member and the ink absorber are engaged with each other, it is desired that at least one of the engagement means and the ink absorber elastically deform.

When the suction ports of the flow path forming member and the ink absorber are engaged with each other, it is desired that the positions where the engagement means applies an engagement force to the ink absorber match the suction ports in a planar direction.

The flow path forming member may be elastically fixed to an exhaust port forming surface of the cap by an elastic fixing member integrally provided to the cap.

Further, the flow path forming member forms paths in the cap by being combined with the exhaust port forming surface of the cap with which the flow path forming member is brought into intimate contact by the elasticity of the fixing means.

According to a further aspect, the present invention provides an ink jet printing apparatus comprising: a printing means having a print head formed with a plurality of ejection ports for ejecting ink; and an ejection recovery means that performs an ejection recovery operation to keep an ink ejection performance of the ejection ports in good condition; wherein the ejection recovery means includes: a cap movable toward and away from the print head, the cap being adapted to cover a plurality of ejection ports formed in the print head when it is moved toward the print head; and a pressure generation means connected to an exhaust port formed in the cap to generate a predetermined pressure; wherein when the cap covers the ejection ports, the pressure generation means causes ink to flow out of the ejection ports and be discharged outside the cap through the exhaust port; wherein a flow path forming member having the suction ports is provided in the cap to form a plurality of paths connecting the suction ports and the exhaust port; wherein the flow path forming member is integrally formed with an engagement means for engaging the ink absorber with the flow path forming member so that the ink absorber capable of absorbing ink can cover the suction ports.

The print head generates bubbles in ink by a thermal energy and ejects ink from the ejection ports by an energy of the bubbles.

According to the invention with the above construction, in a print head having a plurality of columns of ejection ports for ejecting different color inks, ejection recovery operations can be performed simultaneously on the multiple columns of ejection ports with a single cap, while at the same time preventing color inks from getting into the ejection ports of different colors. Further, the mixing of colors during the printing operation can be prevented by ejecting small amounts of color inks before starting printing, thus assuring the forming of an image of normal colors. The reduced amounts of color inks to be discharged for the preliminary ejection can minimize an overall consumption of ink.

Further, in this invention since the cap adapted to cover the ejection ports of the print head is formed with paths having the suction ports and since the engagement means is integrally provided on the flow path forming member to engage the ink absorber with the flow path forming member so that the ink absorber covers the suction ports, the ink that was drawn out of the ejection ports of the print head into the ink absorber can be quickly and stably introduced into the suction ports for discharging outside the cap. Hence the sucked-out ink can be prevented from staying in the cap. Therefore, if multiple kinds of ink are ejected from the print head, not only can the mixing of different colors of ink in the print head be minimized but the color inks can also be prevented from getting back into the ejection ports of different colors. As a result, a printed image of normal color can be obtained by performing the preliminary ejection of small amounts of color inks, which in turn leads to a significant reduction in the overall consumption of ink.

Further, since the fixing means integral with the cap holds the flow path forming member in elastic pressure contact with the exhaust port forming surface of the cap, the flow path forming member can be secured reliably and easily without using adhesives.

Furthermore, the paths connecting the exhaust port and the suction ports can be formed inexpensively and easily by bringing the flow path forming member into intimate contact with the exhaust port forming surface of the cap by the fixing means.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the printing apparatus according to the present invention will be described by referring to the accompanying drawings.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

In the following description we take up as an example a printing apparatus using an ink jet printing system.

I. Fundamental Construction

By referring to FIGS. 1 to 12 a fundamental construction of a printer will be described.

I.1 Apparatus Body

Figure 1:
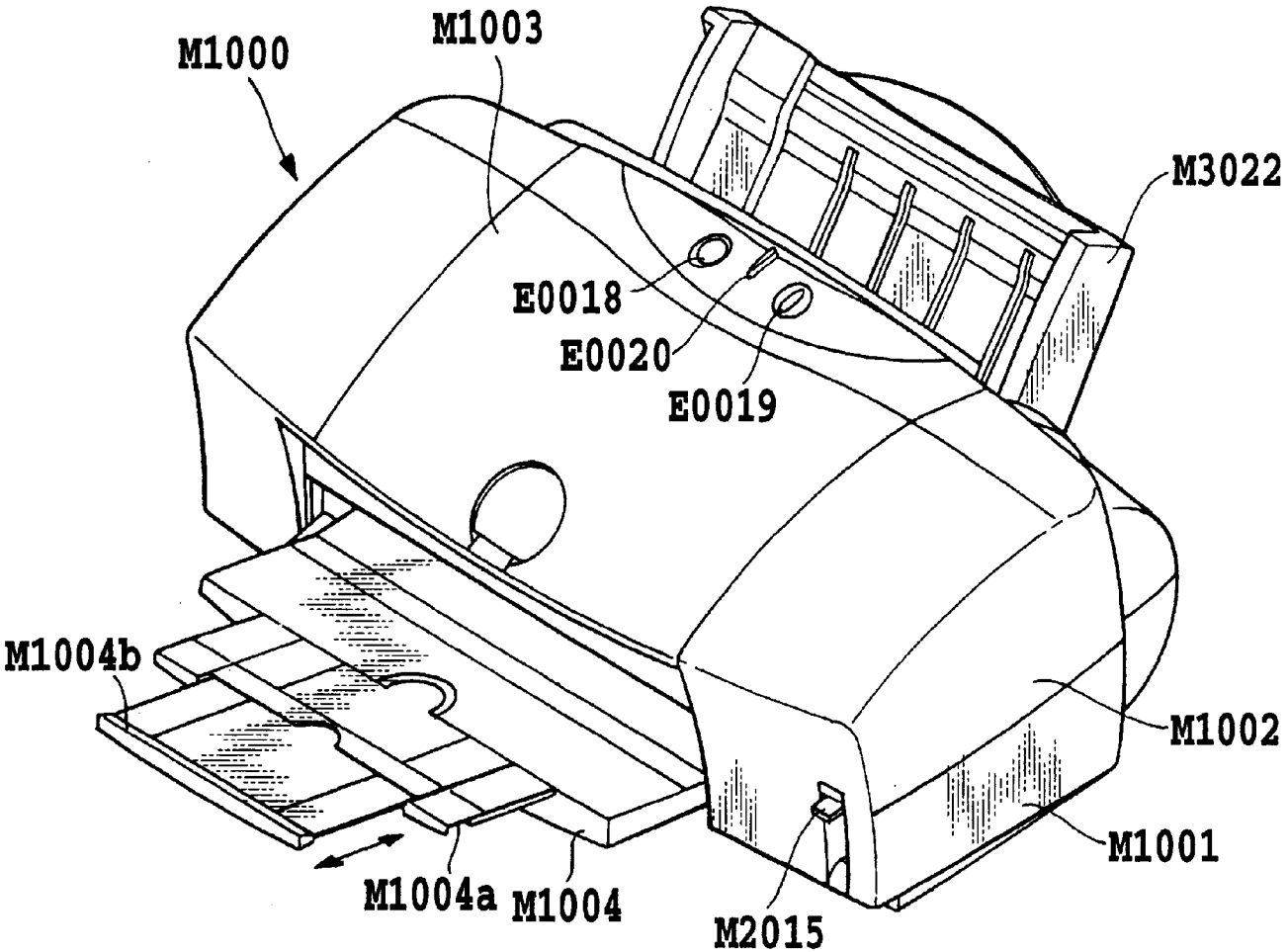
FIG. 1 is a perspective view showing an external construction of an ink jet printer as one embodiment of the present invention.
Figure 2:
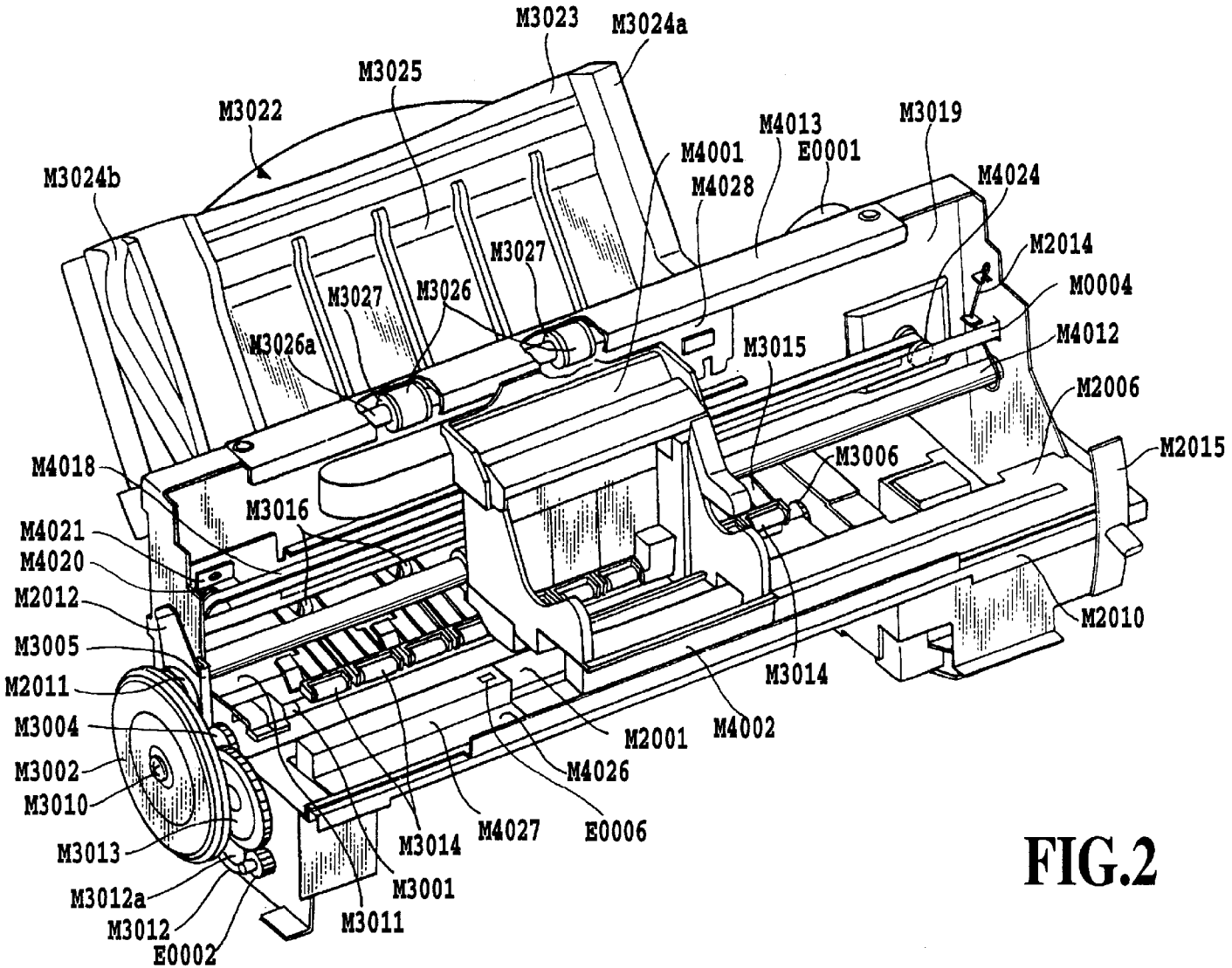
FIG. 2 is a perspective view of FIG. 1 with an enclosure removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

Figure 14A:
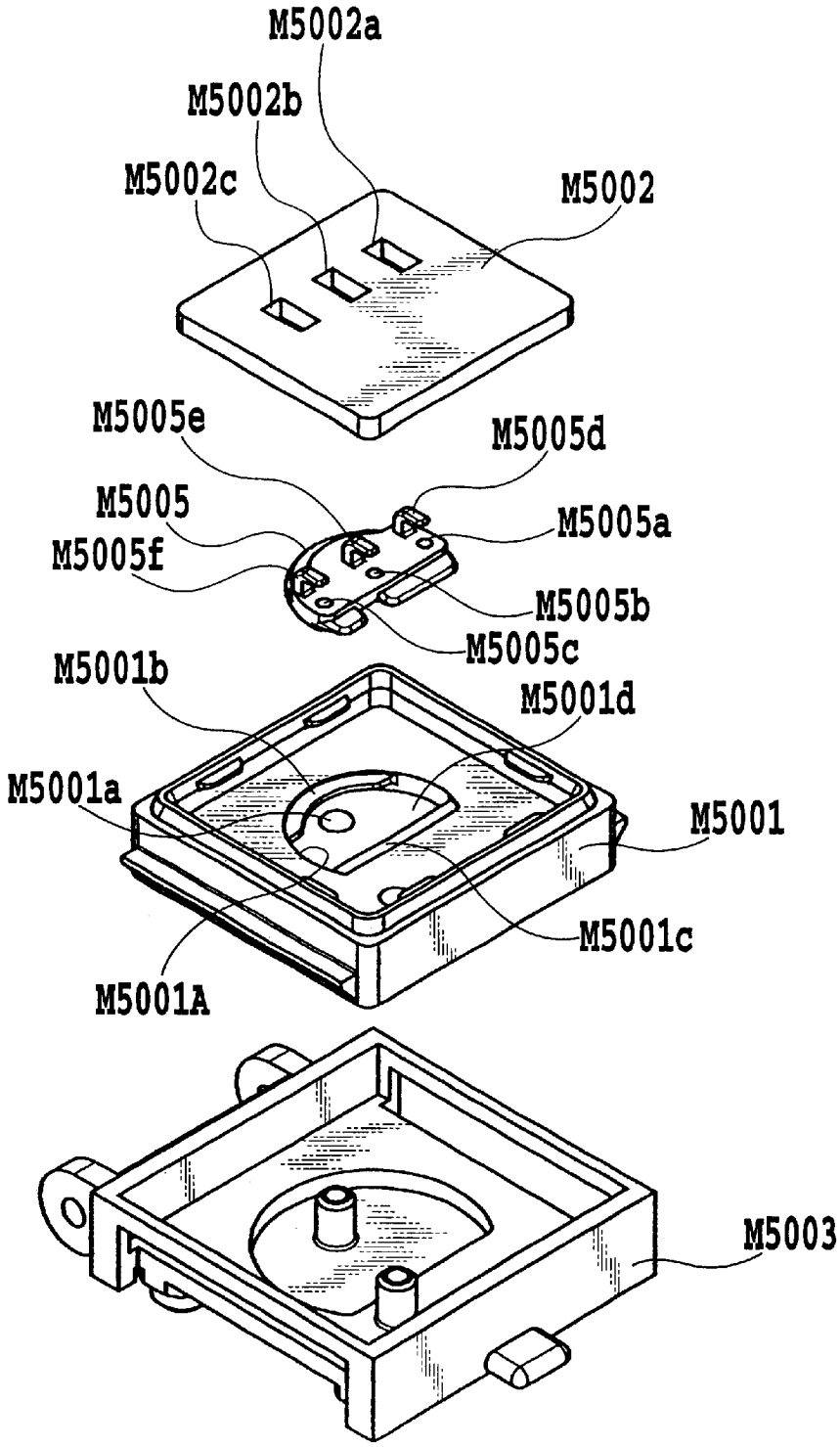
FIG. 14A is an exploded perspective view of the cap unit of FIG. 13 as seen from an upper side.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 14) may be sounded. When the trouble is eliminated, the resume key E0019 is pressed to resume the printing.

I.2 Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit M4000 to perform a desired printing on the print sheet carried to the print position; and an ejection performance recovery unit M5000 to recover the ink ejection performance of the print unit M4000.

Next, the construction of each mechanism will be explained.

I.2.1 Automatic Sheet Feed Unit

By referring to FIGS. 2 and 3 the automatic sheet feed unit M3022 will be described.

The automatic sheet feed unit M3022 in this embodiment horizontally feeds one of print sheets stacked at an angle of about 30–60 degrees to the horizontal plane, so that the sheet is discharged out of a sheet feed port not shown into the printer body while being kept in an almost horizontal attitude.

The automatic sheet feed unit M3022 includes feed rollers M3026, sheet guides M3024*a*, M3024*b*, a pressure plate M3025, an ASF base M3023, sheet separators M3027, and separation claws not shown. The ASF base M3023 forms a housing of the automatic sheet feed unit M3022 and is provided at the back of the printer body. On the front side of the ASF the pressure plate M3025 supporting the print sheets is mounted at an angle of about 30–60 degrees to the horizontal plane and a pair of sheet guides M3024*a*, M3024*b* that guide the ends of the print sheets project forwardly. One of the sheet guides M3024*b* is movable in the sheet width direction to conform to the horizontal size (width) of the sheets.

Rotatably supported on the left and right sides of the ASF base M3023 is a drive shaft M3026*a* that is connected through a gear not shown to a PG motor and which has rigidly secured thereto a plurality of feed rollers M3026 semicircular in cross section.

The print sheets stacked on the pressure plate M3025 are fed by the feed rollers M3026 that are driven by the PG motor E0003 (FIG. 14). The stacked sheets are separated one by one from the top of the stack by the sheet separators M3027 and the separation claws and forwarded to the paper transport unit M3029. The lower end of the pressure plate M3025 is resiliently supported by a pressure plate spring M3028 interposed between the pressure plate M3025 and the ASF base M3023, so that the contact force between the feed rollers and the sheet can be kept constant regardless of the number of sheets stacked.

Figure 3:
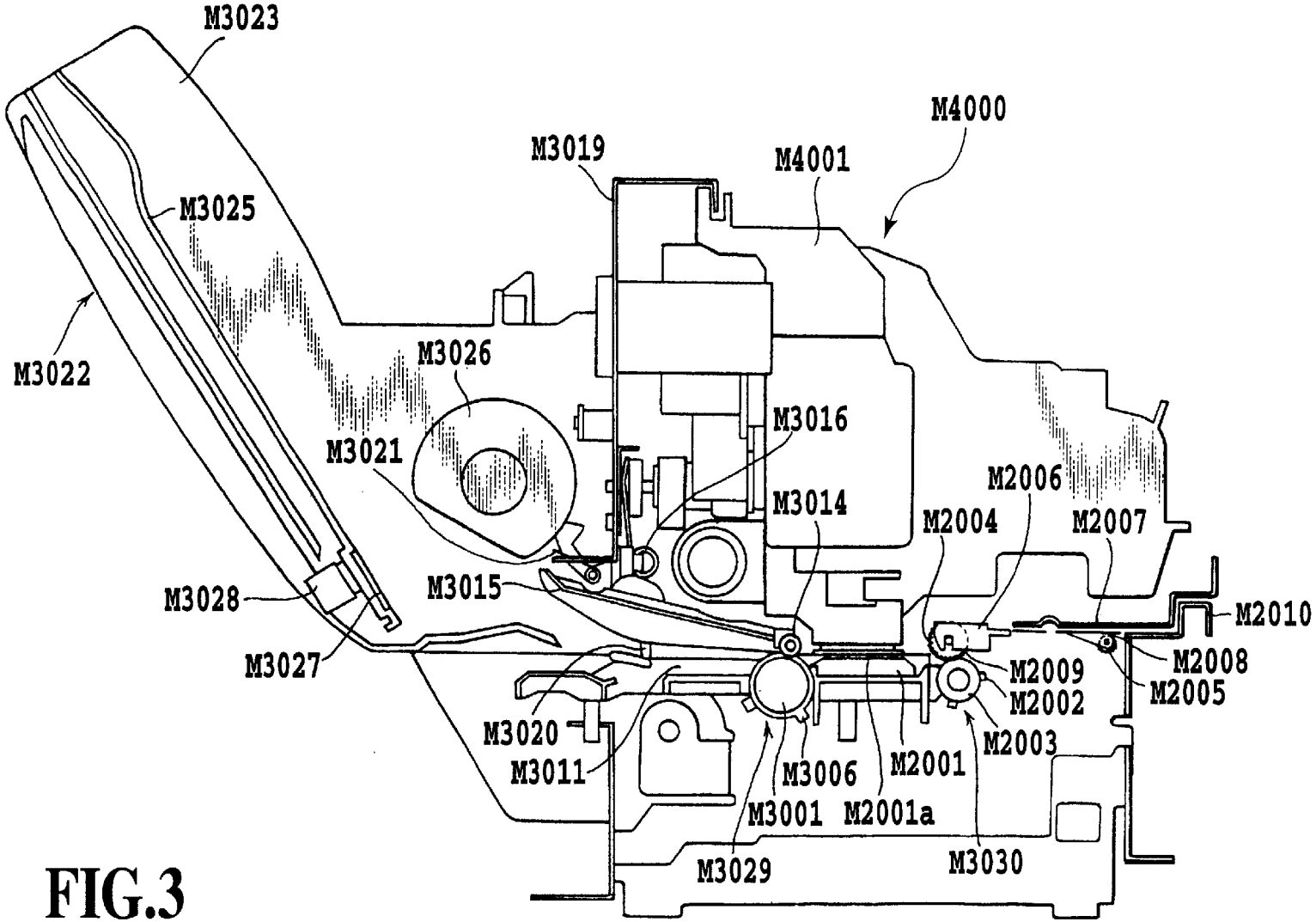
FIG. 3 is a side view of FIG. 2.

In a transport path from the automatic sheet feed unit M3022 to the paper transport unit M3029, a PE lever M3020 urged clockwise in FIG. 3 by a PE lever spring M3021 is pivotally mounted on a chassis M3019 which is secured to the printer body M1000 and formed of a metal plate member with a predetermined rigidity. When the print sheet separated and fed from the automatic sheet feed unit M3022 moves along the path and its front end abuts against one end of the PE lever and pivots it, a PE sensor not shown senses the rotation of the PE lever M3020, detecting that the print sheet has entered into the transport path.

After the entrance into the transport path of the print sheet has been detected, the print sheet is transported a predetermined distance downstream by the feed rollers M3026. That is, the print sheet is fed until its front end contacts a nip portion formed by an LF roller M3001, which is at rest and provided in the paper transport unit described later, and pinch rollers M3014 and the print sheet deflects about 3 mm in loop, at which time the sheet is stopped.

I.2.2 Paper Transport Unit

Figure 4:
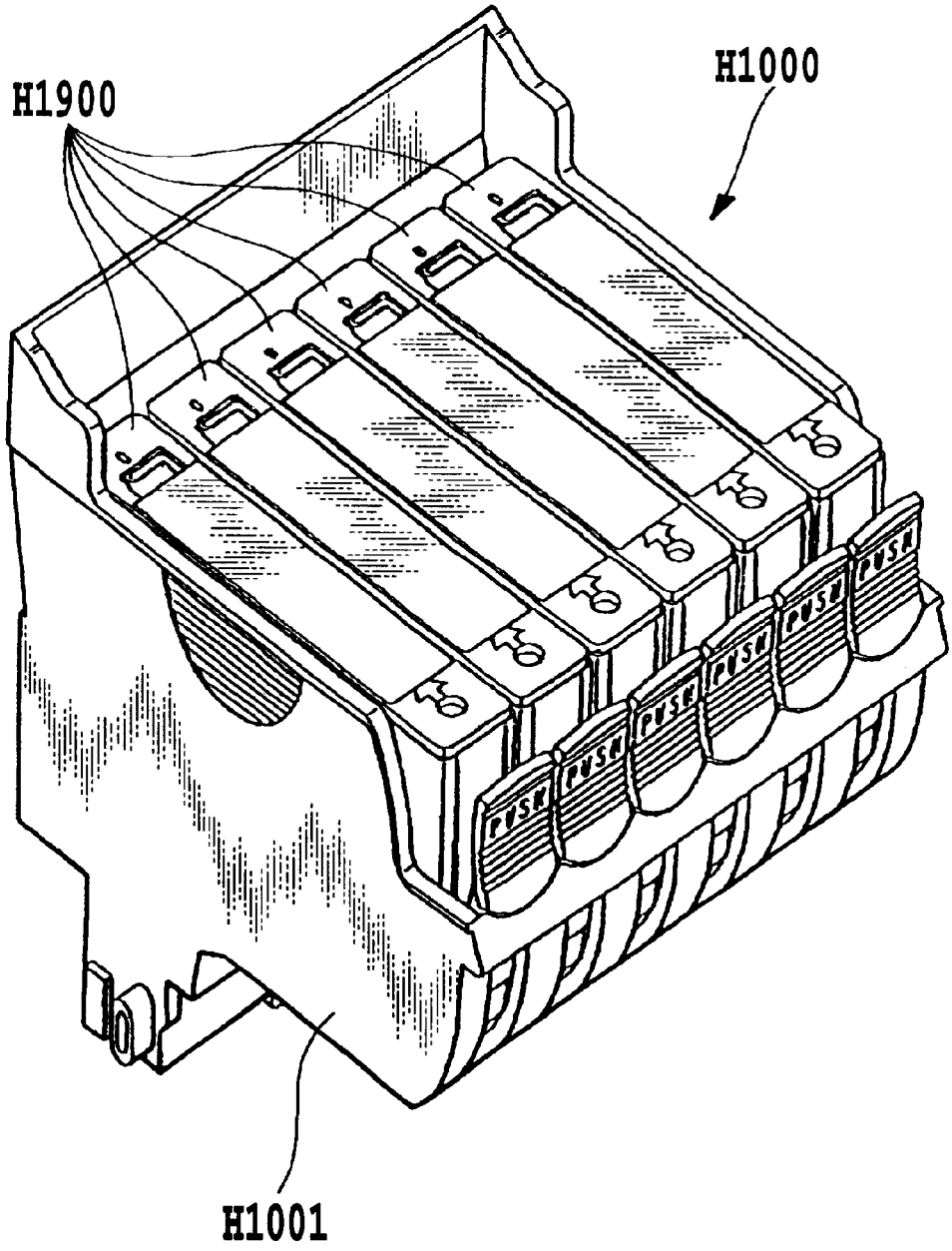
FIG. 4 is a perspective view showing an assembled print head cartridge used in the embodiment of the invention.

The paper transport unit M3029 has an LF roller M3001, pinch rollers M3014 and a platen M2001. The LF roller M3001 is secured to a drive shaft rotatably supported on the chassis M3019 and, as shown in FIG. 4, has attached to one end thereof an LF gear cover M3002 that protects both an LF gear M3003 secured to the drive shaft M3001*a* and a small gear M3012*a* (see FIG. 2) of an LF intermediate gear M3012 in mesh with the LF gear M3003. The LF intermediate gear M3012 is interlocked with a drive gear of a drive shaft of an LF motor E0002 described later and is driven by the driving force of the motor.

The pinch rollers M3014 are rotatably mounted at the front end of pinch roller holders M3015 which is pivotally supported on the chassis M3019. The pinch rollers M3014 are pressed against the LF roller M3001 by spiral spring-like pinch roller springs M3016 that bias the pinch roller holders M3015. As a result, the pinch rollers M3014 rotate following the rotation of the LF roller M3001 to feed forwardly the print sheet, which was at rest in a looped state as described above, by gripping it between the pinch rollers M3014 and the LF roller M3001.

Figure 5:
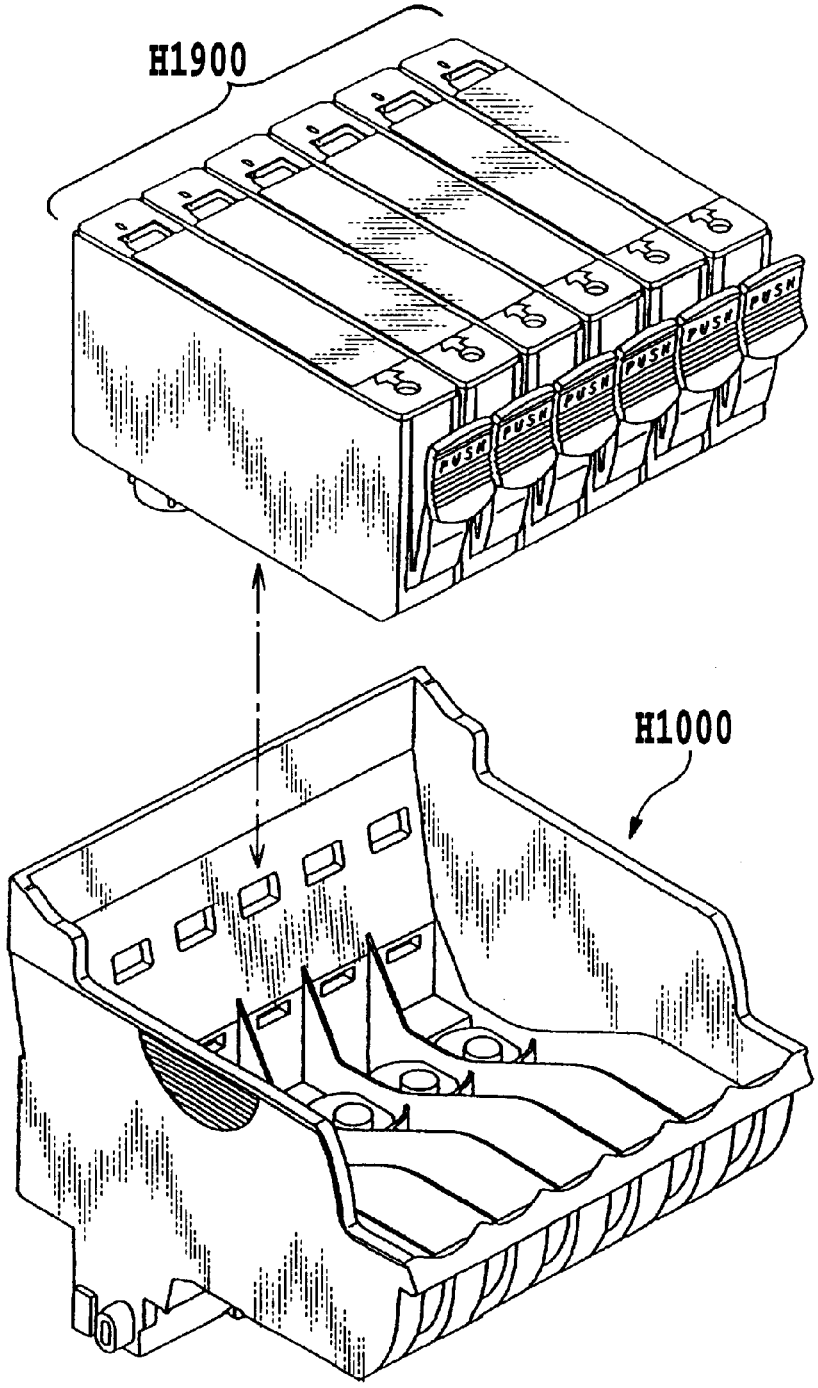
FIG. 5 is a perspective view showing the print head cartridge of FIG. 4 in a disassembled state.

The rotation center of the pinch rollers M3014 is offset about 2 mm downstream of the rotation center of the LF roller M3001 in the direction of transport. Hence, the print sheet fed by the LF roller M3001 and the pinch rollers M3014 advances toward lower right in FIG. 3 along a print sheet support surface M2001*a* (FIG. 5).

A predetermined time after the feeding operation by the feed rollers M3026 of the automatic sheet feed unit M3022 has stopped, the paper transport unit constructed as described above starts the LF motor E0002. The driving force of the LF motor E0002 is transmitted via the LF intermediate gear M3012 and the LF gear M3003 to the LF roller M3001. As the LF roller M3001 rotates, the print sheet whose front end is in contact with the nip portion between the LF roller M3001 and the pinch rollers M3014 is carried to the print start position on the platen M2001.

At this time, the feed rollers M3026 resume rotating simultaneously with the LF roller M3001, so that the print sheet is transported downstream by the cooperation of the feed rollers M3026 and the LF roller M3001 for a predetermined period of time. A print head cartridge H1000 described later moves, mounted on a carriage M4001, along a carriage shaft M4012 secured at its ends to the chassis M3019, the carriage M4001 being adapted to reciprocate in a direction (scan direction) perpendicular to the direction in which the print sheet is fed. As it travels in the scan direction, the print head cartridge H1000 ejects ink, according to an image information, onto the print sheet held at the print start position to form an image.

After the image has been printed, the LF roller M3001 is rotated to feed the print sheet a predetermined distance at a time, which may correspond to one line height of, for example, 5.42 mm, followed by the carriage M4001 performing the main scan along the carriage shaft M4012. This process is repeated to complete an entire image on the print sheet placed on the platen M2001.

The carriage shaft M4012 has its one end mounted on an adjust plate (not shown) through an adjust lever 2015 and the other end mounted on another adjust plate M2012 through a carriage shaft cam M2011. The carriage shaft M4012 is biased by a carriage shaft spring M2014. The adjust plate M2012 and the other adjust plate not shown are secured to the chassis M3019 so that the distance between the ejecting face of the print head cartridge H1000 and the print sheet support surface M2001*a* of the platen M2001 can be adjusted to be an appropriate value.

Further, the adjust lever 2015 can be selectively set at one of two stop positions, an upper end position shown in FIG. 1 and a lower end position not shown. When the adjust lever 2015 is moved to the lower end position, the carriage M4001 is retracted about 0.6 mm from the platen M2001. Hence, if the print sheet is thick, as when an envelope is printed, the adjust lever 2015 is moved to the lower end position before the sheet feeding operation by the automatic sheet feed unit M3022 is started.

Figure 13:
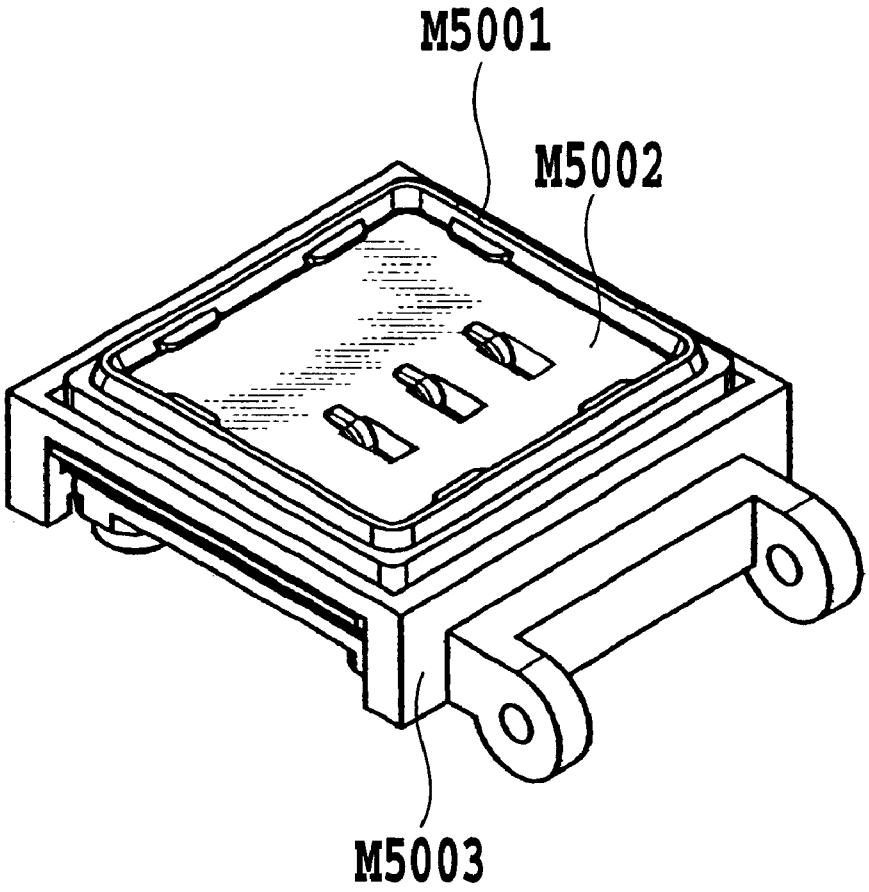
FIG. 13 is a perspective view of a cap unit in the embodiment of the invention.

When the adjust lever 2015 is located at the lower end position, this state is detected by the GAP sensor E0008 (see FIG. 13). Therefore, when the print sheet begins to be fed by the automatic sheet feed unit M3022, it is checked whether the position setting of the adjust lever 2015 is appropriate or not. When an inappropriate state is detected, a warning is issued by displaying a message or activating a buzzer to prevent the printing operation from being executed in an inappropriate condition.

I.2.3 Discharge Unit

Next, the discharge unit M3030 will be described by referring to FIGS. 2 and 3.

As shown in FIG. 3, the discharge unit M3030 has a discharge roller 2003; a discharge gear M3013 mounted on the discharge roller 2003 to transmit the driving force of the LF motor E0002 through the LF intermediate gear M3012 to the discharge roller 2003; a first spur M2004 rotated by the rotation of the discharge roller 2003 to grip the print sheet between it and the discharge roller 2003 to feed the sheet, and a discharge tray M1004 to aid in the discharge of the print sheet. The first spur M2004 is pressed against the discharge roller 2003 by a biasing force of a spur spring M2009 attached to a first spur holder M2006 mounted on a spur stay M2007.

The print sheet carried to the discharge unit M3030 is subjected to the transport force from the discharge roller 2003 and the first spur M2004. The rotation center of the first spur M2004 is offset about 2 mm upstream, in the transport direction, of the rotation center of the discharge roller 2003. Hence, the print sheet moved by the discharge roller 2003 and the first spur M2004 comes into light contact with the print sheet support surface M2001*a* of the platen M2001 with no gap between them and is therefore transported properly and smoothly.

The speed of the print sheet carried by the discharge roller 2003 and the first spur M2004 is almost equal to the speed of the sheet fed by the LF roller M3001 and the pinch roller M3014. To effectively prevent the print sheet from becoming slack, the speed at which the sheet is moved by the discharge roller 2003 and the first spur M2004 is set slightly higher.

Further, a second spur M2005 accommodated in a second spur holder M2008 is held on a part of the spur stay M2007 downstream of the first spur M2004 to prevent the print sheet from coming into a frictional, sliding contact with the spur stay M2007.

When the printing of an image on the print sheet is finished and the rear end of the print sheet comes off from between the LF roller M3001 and the pinch roller M3014, the print sheet is moved only by the discharge roller 2003 and the first spur M2004 until it is completely discharged.

I.2.4 Print Unit

Here, the print unit M4000 will be described. The print unit M4000 comprises a carriage M4001 movably supported on a carriage shaft M4021 and a print head cartridge H1000 removably mounted on the carriage M4001.

I.4.1 Print Head Cartridge

First, the print head cartridge used in the print unit will be described with reference to FIGS. 4 to 8.

The print head cartridge H1000 in this embodiment, as shown in FIG. 4, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 5, these individual ink tanks are removably mounted to the print head H1001.

Figure 6:
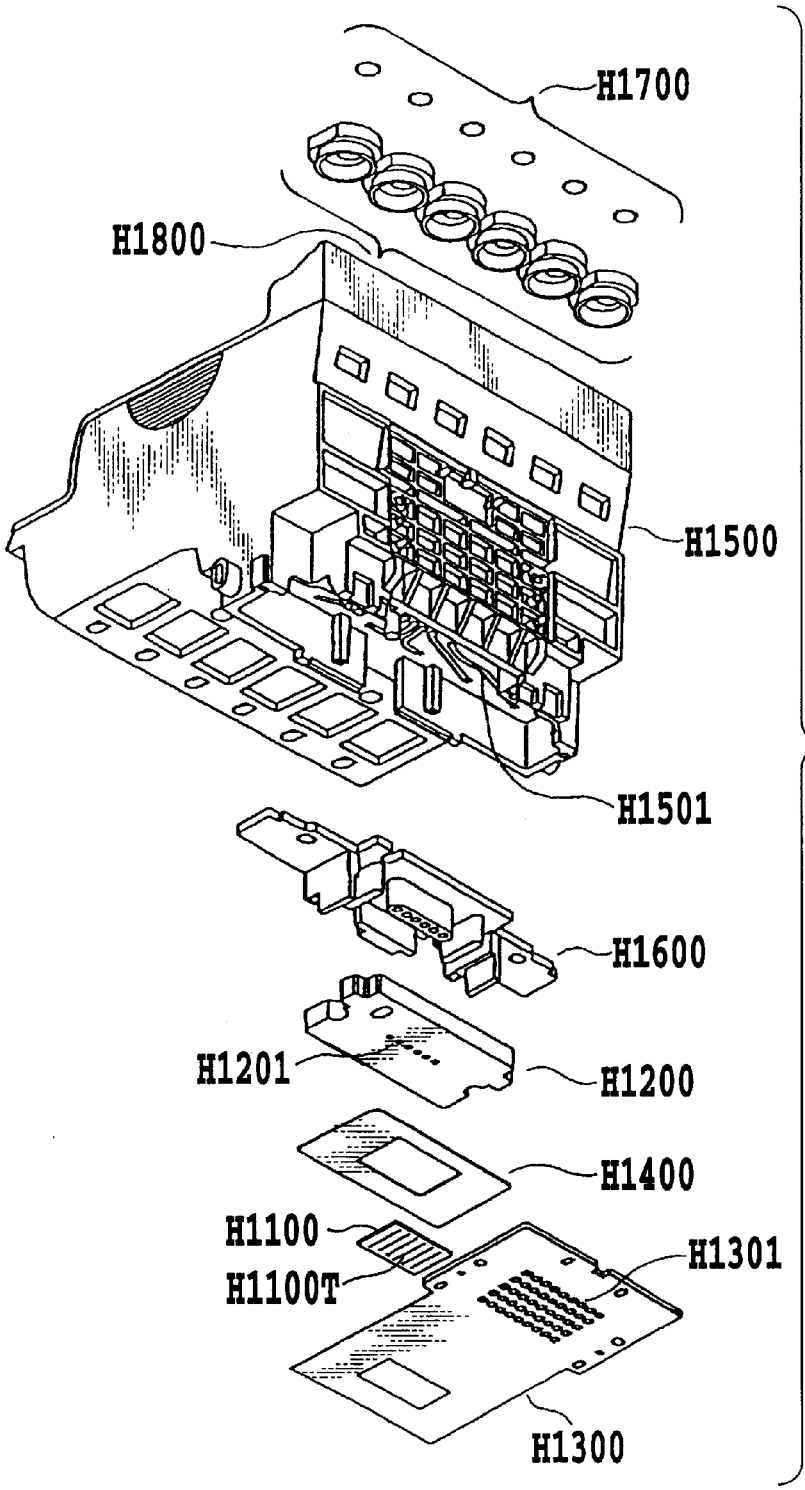
FIG. 6 is an exploded perspective view of the print head of FIG. 5 as seen from diagonally below.
Figure 7:
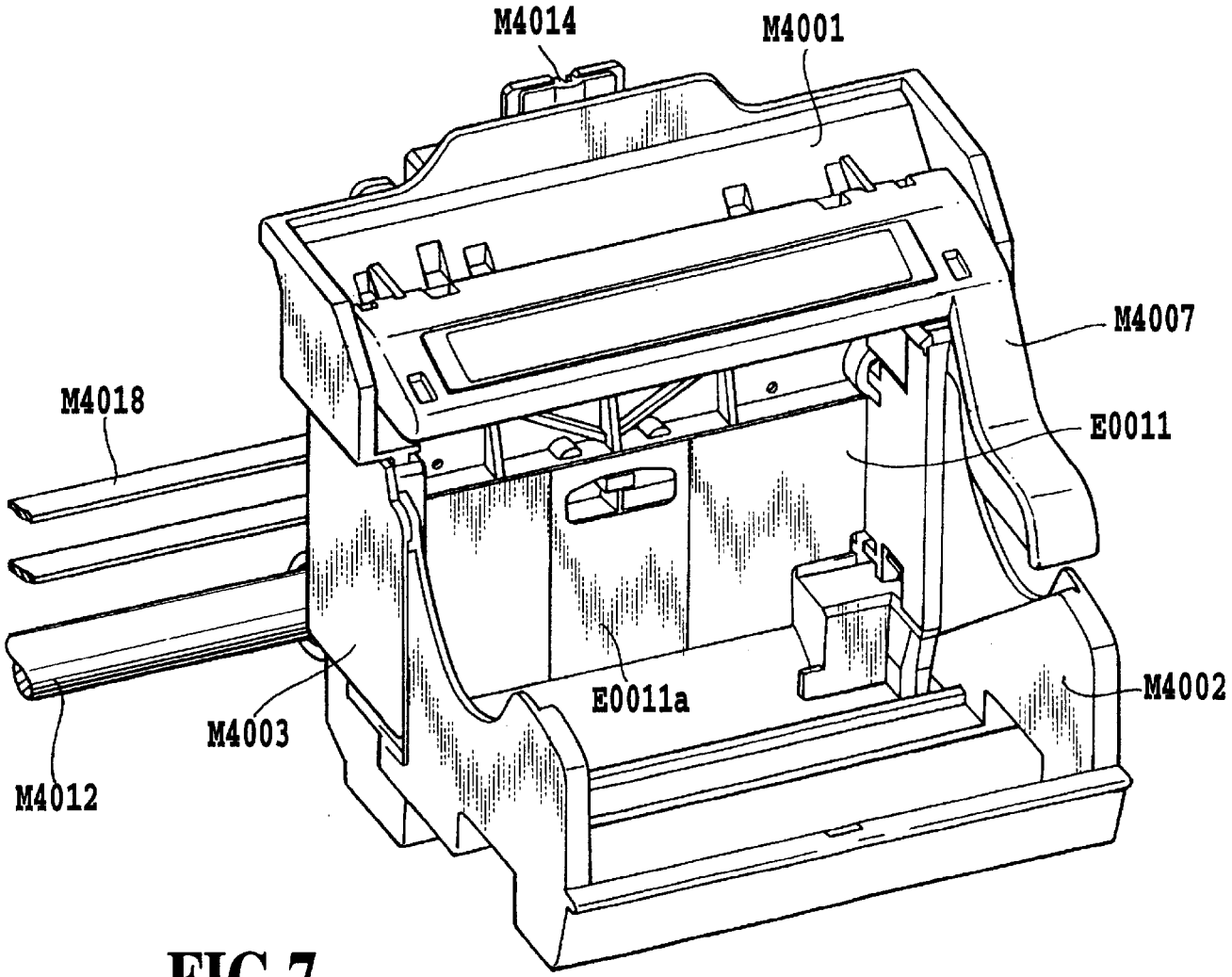
FIG. 7 is a perspective view showing a front side of a carriage used in the embodiment of the invention.
Figure 8:
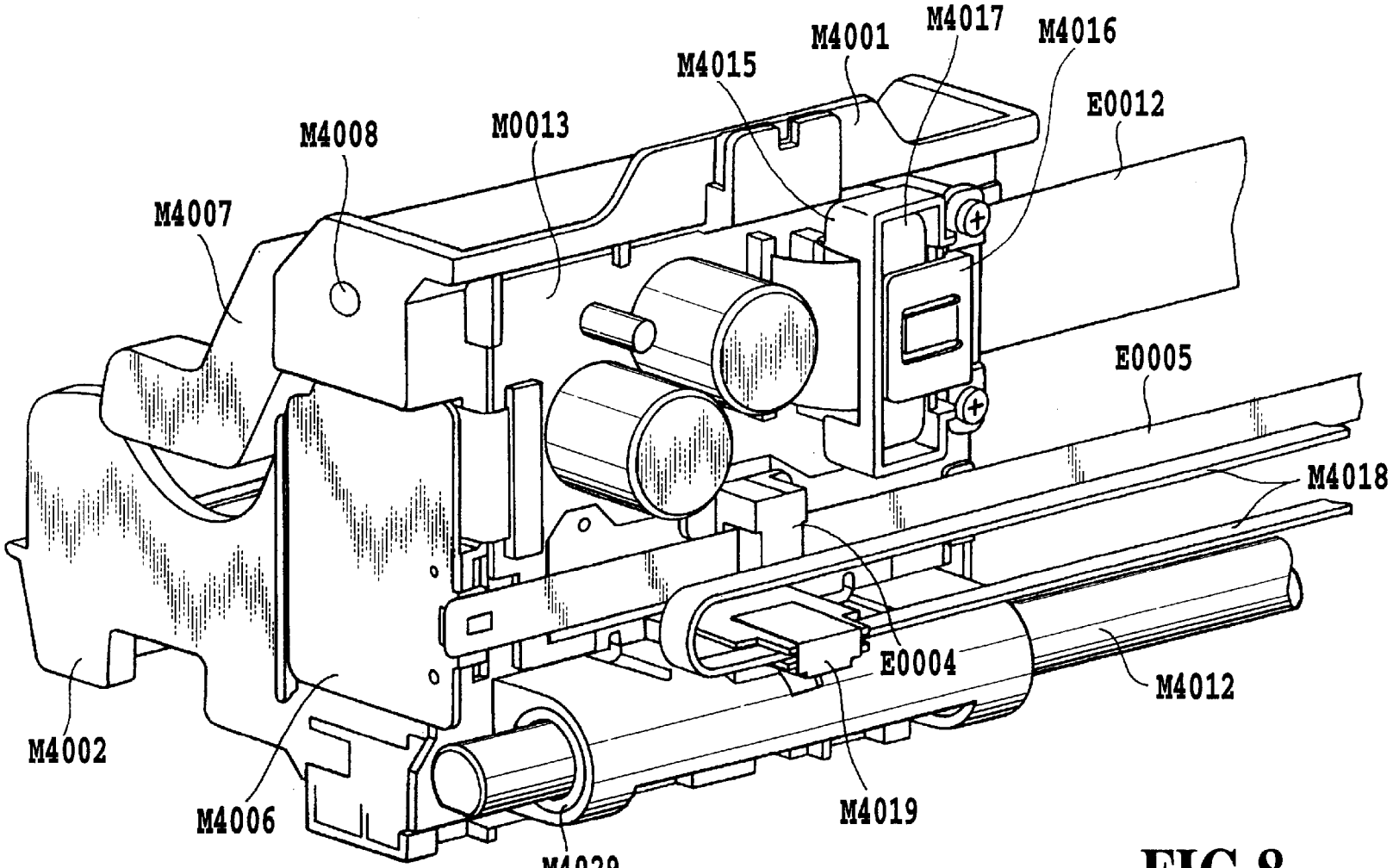
FIG. 8 is a perspective view showing a rear side of the carriage of FIG. 7.

Then, the print head H1001, as shown in the perspective view of FIG. 6, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

I.4.2.2 Carriage

Next, by referring to FIGS. 2, 9 and 10, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft M4008. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (simply referred to as a contact FPC hereinafter) E0011 whose contact unit E0011*a* electrically contacts a contact portion (external signal input terminals) H1301 provided in the print head H1001 to transfer various information for printing and supply electricity to the print head H1001.

An elastic member such as rubber not shown is provided between a contact unit E0011*a* of a contact FPC E0011 and the carriage M4001. The elastic force of the elastic member and the pressing force of the head set lever spring combine to ensure a reliable contact between the contact unit E0011*a* and the carriage M4001. The contact FPC E0011 is drawn to the sides of the carriage M4001 and, as shown in FIGS. 9 and 10, has its end portions securely held to the sides of the carriage M4001 by a pair of FPC retainers M4003, M4006. The contact FPC E0011 is connected to a carriage printed circuit board E0013 mounted on the back of the carriage M4001 (see FIG. 11).

Figure 11:
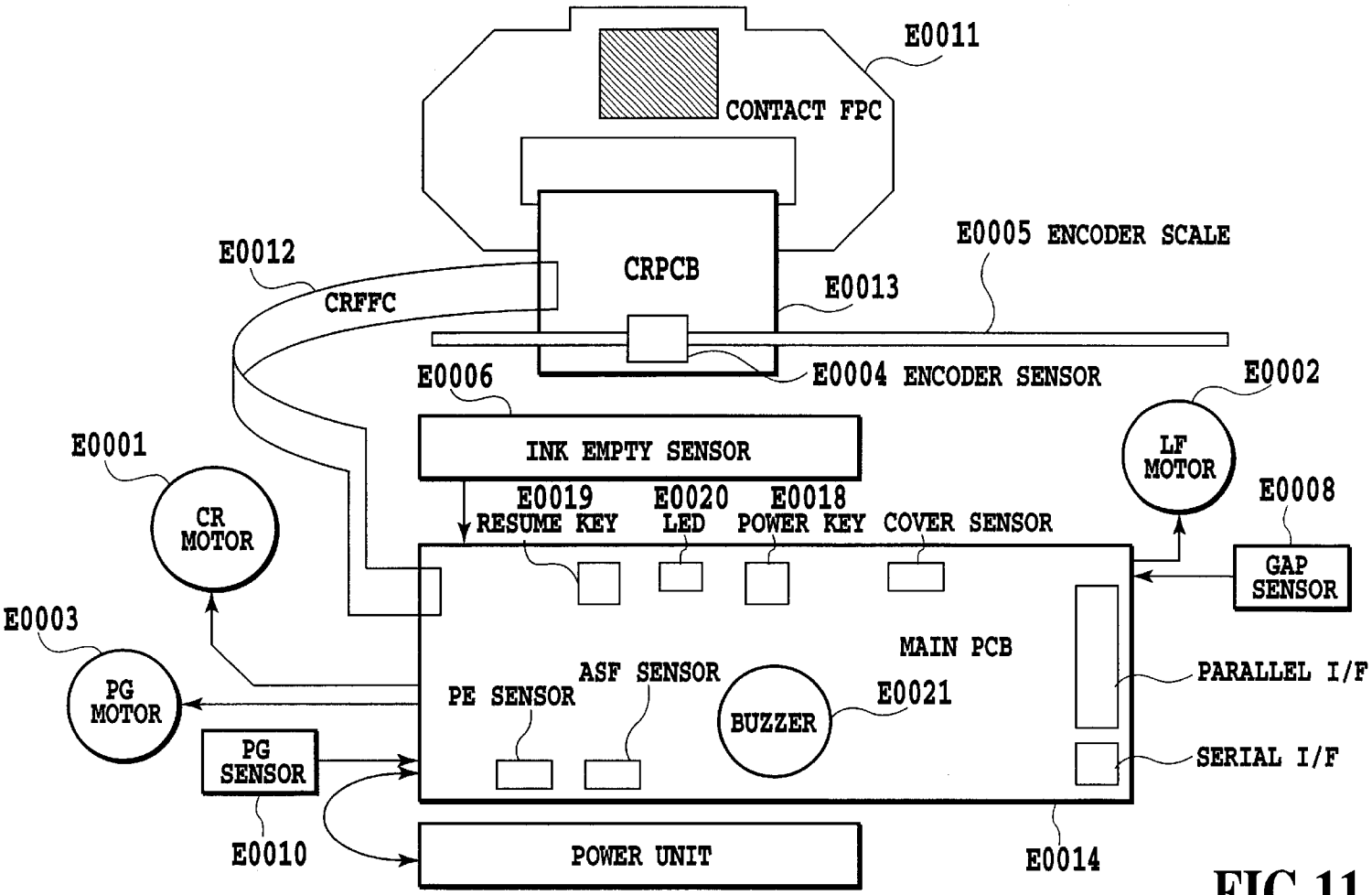
FIG. 11 is a block diagram schematically showing an overall configuration of an electric circuit in the embodiment of the invention.

As shown in FIG. 11, the carriage printed circuit board E0013 is electrically connected through a carriage flexible flat cable (carriage FFC) E0012 to a main printed circuit board E0014 mounted on the chassis M3019 (see FIG. 11), which will be described later. Further, as shown in FIG. 11, at a joint portion between one end of the carriage FFC E0012 and the carriage printed circuit board E0013 a pair of retainer members, flexible flat cable retainers (FCC retainers) M4015, M4016, are provided to fixedly secure the carriage FFC E0012 to the carriage printed circuit board E0013 (see FIG. 11). Also installed at the joint portion is a ferrite core M4017 that shields electromagnetic radiations emitted from the carriage FFC E0012 and others.

The other end of the carriage FFC E0012 is fixed to the chassis M3019 (FIG. 2) by an FFC retainer M4028 (FIG. 2) and then drawn out to the rear side of the chassis M3019 through a hole not shown in the chassis M3019 and connected to the main printed circuit board E0014 (FIG. 11).

As shown in FIG. 11, the carriage printed circuit board E0013 has an encoder sensor E0004, which detects information from an encoder scale E0005 extending parallel to the carriage shaft M4012 between the both sides of the chassis M3019 to detect the position and scan speed of the carriage M4001. In this embodiment, the encoder sensor E0004 is of an optical transmission type. The encoder scale E0005 is a resin film, such as polyester film, which is printed, by the photographic plate making technique, alternately at a predetermined pitch with light shielding portions for shielding detection light emitted from the encoder sensor and light transmitting portions for transmitting the detection light.

Therefore, the position of the carriage M4001 moving along the carriage shaft M4012 can be detected at any time by first putting the carriage M4001 against one side plate of the chassis M3019 provided at an end of the scanning track of the carriage M4001, taking this position as a reference position, and counting the number of patterns formed on the encoder scale E0005 by the encoder sensor E0004 as the carriage M4001 performs scanning.

The carriage M4001 is guided for scan operation along the carriage shaft M4012 and the carriage rail M4013 extending between the both sides of the chassis M3019. At bearing portions for the carriage shaft M4012, the carriage M4001 has integrally formed therewith as by an insert molding a pair of carriage shaft bearings M4029 made of a sintered metal impregnated with lubricant such as oil. Further, at a portion engaging with the carriage rail M4013, the carriage M4001 has a carriage slider (CR slider) M4014 made of resin with excellent sliding performance and wear resistance. Along with the carriage shaft bearings M4029, the CR slider M4014 enables a smooth scanning motion of the carriage M4001.

The carriage M4001 is secured to a carriage belt M4018 that extends almost parallel to the carriage shaft between an idler pulley M4020 (FIG. 2) and a carriage motor pulley M4024 (FIG. 2). The carriage motor E0001 (FIG. 13) drives the carriage motor pulley M4024 to move the carriage belt M4018 in the forward or backward direction and thereby scan the carriage M4001 along the carriage shaft M4012. The carriage motor pulley M4024 is held at a fixed position by the chassis, whereas the idler pulley M4020 together with a pulley holder M4021 is held movable relative to the chassis M3019. Because the idler pulley M4020 is urged away from the carriage motor pulley M4024 by a spring, the carriage belt M4018 wound around the both pulleys M4020 and M4024 is given an appropriate tension at all times and thus kept in good state with no slack.

At the connecting portion between the carriage belt M4018 and the carriage M4001 is provided a carriage belt holder M4019 that ensures a secure holding of the carriage M4001 to the belt.

On the spur stay M2006 in the scanning track of the carriage M4001 an ink empty sensor E0006 (FIG. 2) is exposed facing an ink tank H1900 to measure the remaining amount of ink contained in the ink tank H1900 of the print head cartridge H1000 mounted on the carriage M4001. The ink empty sensor E0006 is held by an ink empty sensor holder M4026 and accommodated in an ink empty sensor cover M4027 having a metal plate to shield noise from outside, thus preventing erroneous operations of the sensor.

I.5 Ejection Performance Recovery Unit

Figure 12:
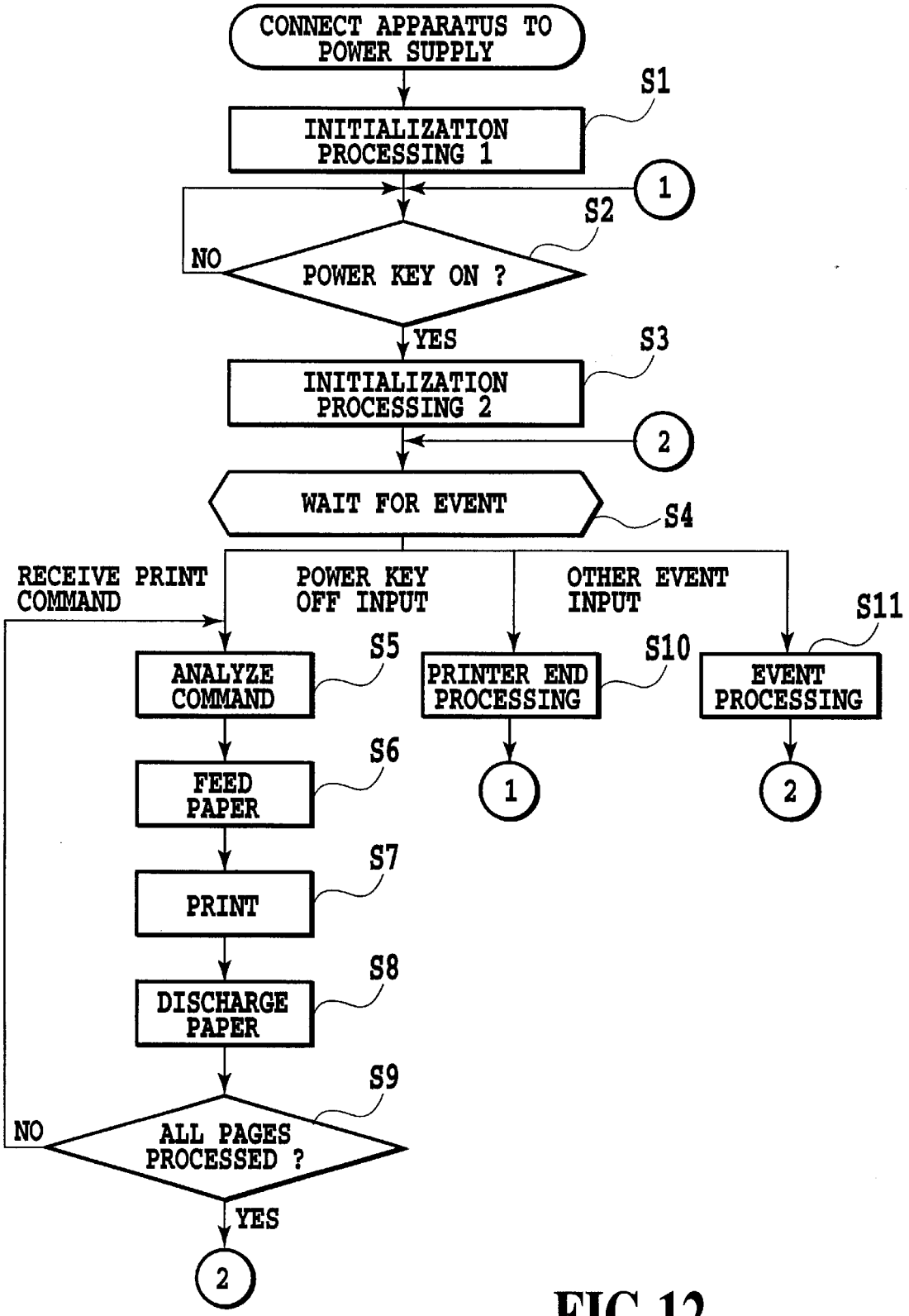
FIG. 12 is a flow chart showing a sequence of operations performed in the embodiment of the invention.

Next, by referring to FIGS. 11 and 12, an ejection performance recovery unit that recovers the ejection performance of the print head cartridge H1000 will be described.

The ejection performance recovery unit 5000 in this embodiment can be mounted to and dismounted from the printer body M1000. The ejection performance recovery unit M5000 has a cleaning means to remove foreign matters adhering to a print element substrate H1100 of the print head H1001 and a recovery means to reinstate the normal condition of the ink path from the ink tank H1900 to the print element substrate H1100 of the print head H1001 (flow path from the portions H1501 to H1400 via H1600).

Figure 10:
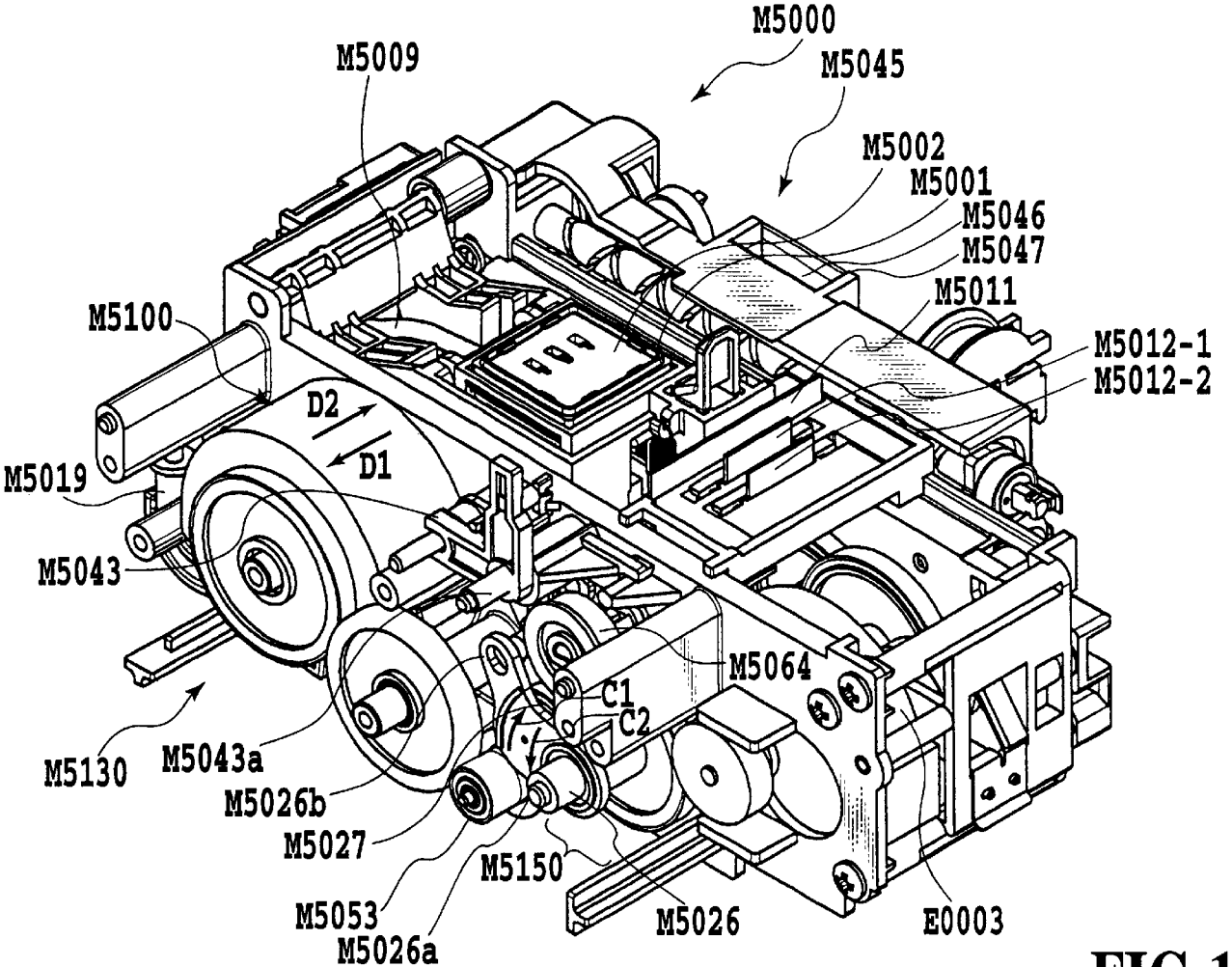
FIG. 10 is a perspective view showing the other side of the recovery unit of FIG. 9.

In FIG. 10, denoted E0003 is a PG motor which drives a cap M5001 to be described later, a pump M5100, wiper blades M5011, M5012-1, M5012-2 and the automatic sheet feed unit M3022. The driving force is extracted from both sides of the motor shaft of the PG motor E0003. The driving force extracted from one side is transmitted to the pump M5100 or the automatic sheet feed unit M3022 through a drive path switching means described later. The driving force extracted from the other side is transmitted to the cap M5001 and the wiper blades M5011, M5012-1, M5012-2 through a one-way clutch M5041 that engages when the PG motor E0003 rotates only in a particular direction (this rotation direction is referred to as a forward direction and the opposite direction as a reverse direction). Hence, when the PG motor E0003 is rotating in the reverse direction, the one-way clutch M5041 disengages blocking the driving force from being transmitted, so that the cap M5001 and the wiper blades M5011, M5012-1, M5012-2 are not operated.

The cap M5001 is made of an elastic member such as rubber and mounted on a cap lever M5004 that can be pivoted about its axis. The cap M5001 is moved in the direction of arrow A (FIG. 9) through the one-way clutch M5041, a cap drive transmission gear train M5110, a cap cam and the cap lever M5004 so that it can be brought into and out of contact with the print element substrate H1100 of the print head H1001. In the cap M5001 there is provided an absorbing member M5002 which is arranged to oppose the print element substrate H1100 with a predetermined gap therebetween during a capping operation.

The absorbing member M5002 disposed in this way can accept ink drawn out from the print head cartridge H1000 during the suction operation. Further, the ink in the cap M5001 can be discharged out into a used ink absorbing member completely by an evacuation operation described later. The cap M5001 is connected with two tubes, a cap tube M5009 and a valve tube M5010. The cap tube M5009 is connected to a pump tube M5019 of a pump M5100 described later and the valve tube M5010 to a valve rubber M5036 described later.

The wiper blades M5011, M5012-1, M5012-2 are made of elastic members such as rubber and are erected on a blade holder M5013 so that their edges project upward. The blade holder M5013 has a lead screw M5031 inserted therethrough with a projection not shown of the blade holder M5013 movably engaging in a groove formed in the lead screw M5031. As the lead screw M5031 rotates, the blade holder M5013 moves back and forth along the lead screw M5031 in the direction of arrow B1 or B2 (FIG. 9), causing the wiper blades M5011, M5012-1, M5012-2 to wipe clean the print element substrate H1100 of the print head cartridge H1000. The lead screw M5031 is connected to one side of the PG motor E0003 through the one-way clutch M5041 and a wiper drive transmission gear train M5120.

Designated M5100 is a pump that produces a pressure by pressing a roller (not shown) against and moving it along the pump tube M5019. This pump is connected to the other side of the PG motor E0003 via a drive path switching means and the pump drive transmission gear train M5130. The drive path switching means switches the driving force transmission path between the automatic sheet feed unit M3022 and the pump M5100. Although details are not provided, the pump M5100 has a mechanism to release the pressing force with which the roller (not shown) is pressed against the pump tube M5019 to squeeze it. When the PG motor E0003 rotates in the forward direction, the mechanism releases the pressing force from the roller, leaving the tube intact. When the PG motor E0003 rotates in the reverse direction, the mechanism applies the pressing force to the roller to squeeze the tube. One end of the pump tube M5019 is connected to the cap M5001 through the cap tube M5009.

The drive path switching means has a pendulum arm M5026 and a selector lever M5043. The pendulum arm M5026 is pivotable about a shaft M5026*a* in the direction of arrow C1 or C2 (FIG. 10) depending on the rotation direction of the PG motor E0003. The selector lever M5043 is switched according to the position of the carriage M4001. That is, when the carriage moves M4001 to a position over the ejection performance recovery unit M5000, a part of the selector lever M5043 is contacted by a part of the carriage M4001 and moved in the direction of arrow D1 or D2 (FIG. 10) depending on the position of the carriage M4001, with the result that a lock hole M5026*b* of the pendulum arm M5026 and a lock pin M5043*a* of the selector lever M5043 engage.

The valve rubber M5036 is connected with one end of the valve tube M5010 the other end of which is connected to the cap M5001. A valve lever M5038 is connected to the discharge roller 2003 (FIG. 5) through a valve cam M5035, a valve clutch M5048 and a valve drive transmission gear train M5140. As the discharge roller 2003 rotates, the valve lever M5038 is pivoted about a shaft M5038*a* in the direction of arrow E1 or E2 to come into or out of contact with the valve rubber M5036. When the valve lever M5038 is in contact with the valve rubber M5036, the valve is closed. When the lever is parted, the valve is open.

Denoted E0010 is a PG sensor that detects the position of the cap M5001.

Next, the operations of the ejection performance recovery unit M5000 of the above construction will be explained.

First, let us explain about the driving operation of the automatic sheet feed unit M3022.

When, with the carriage M4001 at the retracted position where it does not contact the selector lever M5043, the PG motor E0003 rotates in the reverse direction, the pendulum arm M5026 is pivoted in the direction of arrow C1 (FIG. 11) through a pendulum drive transmission gear train M5150, causing a selector output gear M5027 mounted on the pendulum arm M5026 to mesh with an ASF gear M5064 at one end of an ASF drive transmission gear train M5160. When in this state the PG motor E0003 continues to rotate in the reverse direction, the automatic sheet feed unit M3022 is driven by the PG motor through the ASF drive transmission gear train M5160. At this time, the driving force is not transmitted to the cap M5001 and the wiper blades M5011, M5012-1, M5012-2 because the one-way clutch M5041 is disengaged. Thus, the wiper blades are not operated.

Next, the suction operation of the pump M5100 will be described.

When, with the carriage M4001 at the retracted position where it does not contact the selector lever M5043, the PG motor E0003 rotates in the forward direction, the pendulum arm M5026 is pivoted in the direction of arrow C2 through the pendulum drive transmission gear train M5150, causing the selector output gear M5027 mounted on the pendulum arm M5026 to mesh with a pump gear M5053 at one end of the pump drive transmission gear train M5130.

Then, when the carriage M4001 moves to the capping position (a carriage position where the print element substrate H1100 of the print head cartridge H1000 faces the cap M5001), a part of the carriage M4001 abuts against a part of the selector lever M5043, which is then moved in the direction of D1, causing the lock pin M5043*a* of the selector lever M5043 to fit into the lock hole M5026*b* of the pendulum arm M5026. As a result, the pendulum arm M5026 is locked connected to the pump side.

Here, the discharge roller 2003 is driven in the reverse direction and the valve lever M5038 is rotated in the direction of arrow E1, opening the valve rubber M5036. In this open state, the PG motor E0003 rotates in the forward direction to drive the cap M5001 and the wiper blades M5011, M5012-1, M5012-2 to perform the capping operation (an operation whereby the cap M5001 hermetically contacts and covers the print element substrate H1100 of the print head H1001). At this time, the pump M5100 is operated but the pressing force of a roller (not shown) against the pump tube M5019 is released, so that the pump tube M5019 is not worked and no pressure is generated.

When the discharge roller 2003 is driven in the forward direction and the valve lever M5038 is pivoted in the direction of arrow E2 (FIG. 9), the valve rubber M5036 is closed. At this time, the PG motor E0003 rotates in the reverse direction to squeeze the pump tube M5019 by the pressing force of the roller to apply a negative pressure to the print element substrate H1100 of the print head cartridge H1000 through the cap tube M5009 and the cap M5001, forcibly drawing out ink and foams not suited for printing from the nozzles in the print element substrate H1100.

Figure 9:
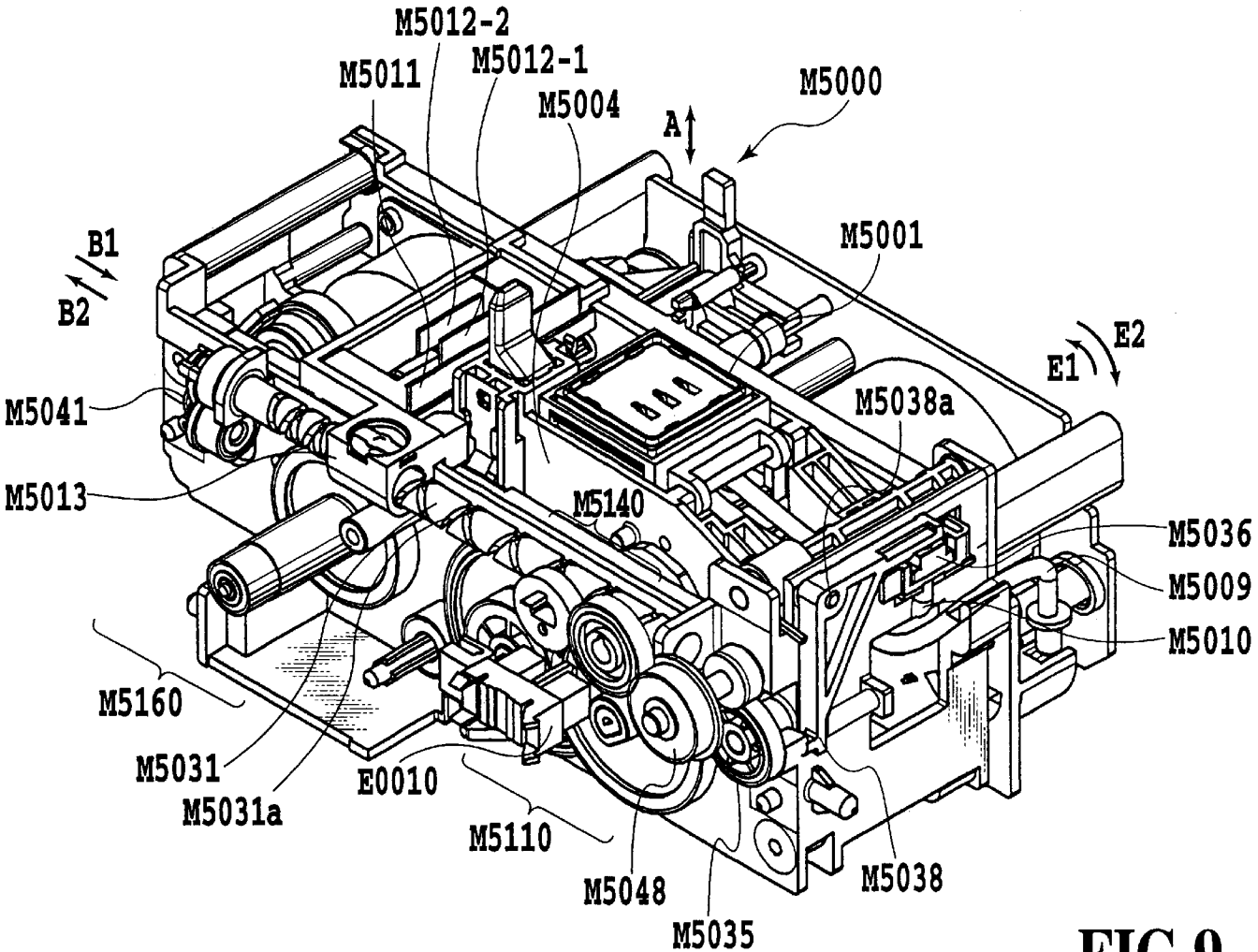
FIG. 9 is a perspective view showing one side of a recovery unit in the embodiment of the invention.

After this, the PG motor E0003 rotates in the reverse direction and at the same time the discharge roller 2003 is driven in the reverse direction to pivot the valve lever M5038 in the direction of arrow E1 (FIG. 9). Now the valve rubber M5036 is open. As a result, the pressure in the pump tube M5019, the cap tube M5009 and the cap M5001 is equal to an atmospheric pressure, stopping the forced suction of the ink nozzles in the print element substrate H1100 of the print head cartridge H1000. At the same time, the ink contained in the pump tube M5019, the cap tube M5009 and the cap M5001 is drawn out from the other end of the pump tube M5019 into the used ink absorbing member (not shown). This operation is referred to as an evacuation. Then, the PG motor E0003 is stopped, the discharge roller 2003 is driven in the forward direction and the valve lever M5038 is pivoted in the direction of arrow E2 (FIG. 12), closing the valve rubber M5036. Now the suction operation is finished.

Next, the wiping operation will be explained.

During the wiping operation, the PG motor E0003 is first rotated in the forward direction to move the wiper blades M5011, M5012-1, M5012-2 to the wiping start position (a position where the wiper blades M5011, M5012-1, M5012-2 are upstream of the print head cartridge H1000 in the printing operation, with the cap M5001 separated from the print head cartridge H1000). Next, the carriage M4001 moves to a wiping position where the wiper blades M5011, M5012-1, M5012-2 face the print element substrate H1100. At this time, the carriage M4001 is not in contact with the selector lever M5043 and the pendulum arm M5026 is not in the locked state.

Then, the PG motor E0003 rotates in the forward direction to move the wiper blades M5011, M5012-1, M5012-2 in the direction of arrow B1 (FIG. 9) wiping clean the print element substrate H1100 of the print head cartridge H1000. Further, a wiper blade cleaning means (not shown) provided downstream of the print element substrate H1100 of the print head cartridge H1000 in the direction of the printing operation clears the wiper blades of the adhering ink. At this time, the cap M5001 is kept in the separated state.

When the wiper blades reach the wiping end position (a downstream end position in the printing operation), the PG motor is stopped and the carriage M4001 is moved to the wiping standby position out of the wiping operation range of the wiper blades M5011, M5012-1, M5012-2. Then, the PG motor E0003 is rotated in the forward direction to move the wiper blades to the wiping end position. At this time, too, the cap M5001 is maintained in the separated state. Now, the wiping operation is finished.

Next, the preliminary ejection will be explained.

Performing the suction operation and the wiping operation on a print head that uses a plurality of inks may cause a problem of ink mixing.

For example, during the suction operation, ink drawn out from the nozzles may get into nozzles of other color inks and, during the wiping operation, inks of various colors adhering to the circumferences of the nozzles may be pushed into nozzles of different color inks by the wipers. When the next printing is started, the initial part of the printed image may be discolored (or exhibit mixed colors), degrading the printed image.

To prevent the color mixing, the ink that may have mixed with other color inks is ejected out immediately before printing. This is called a preliminary ejection. In this embodiment, as shown in FIG. 11, a preliminary ejection port M5045 is arranged near the cap M5001. Immediately before printing, the print element substrate H1100 of the print head is moved to a position opposing the preliminary ejection port M5045 where it is subjected to the preliminary ejection operation.

The preliminary ejection port M5045 has a preliminary ejection absorbing member M5046 and a preliminary ejection cover M5047. The preliminary ejection absorbing member M5046 communicates with the used ink absorbing member not shown.

II. 1 Operation of Printer

Next, the operation of the ink jet printing apparatus in this embodiment of the invention with the above configuration will be explained by referring to the flow chart of FIG. 12.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

(Characteristic Constructions)

Next, characteristic constructions of a printer in this embodiment with the above basic construction will be explained by referring to the accompanying drawings.

Figure 14B:
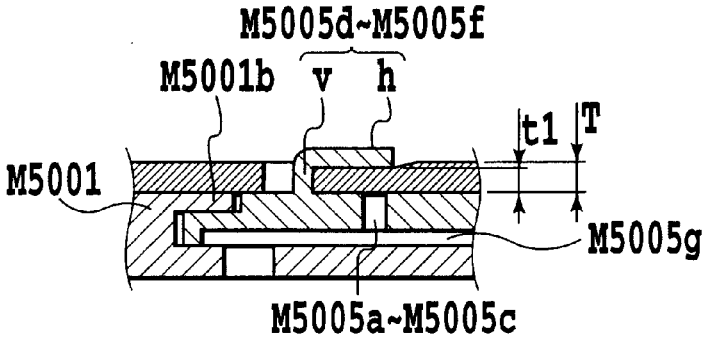
FIG. 14B and FIG. 14C are vertical side views of a retainer member shown in FIG. 14A.
Figure 14C:
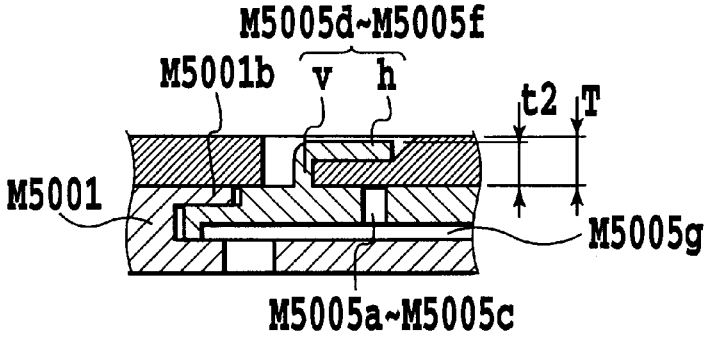
Figure 15:
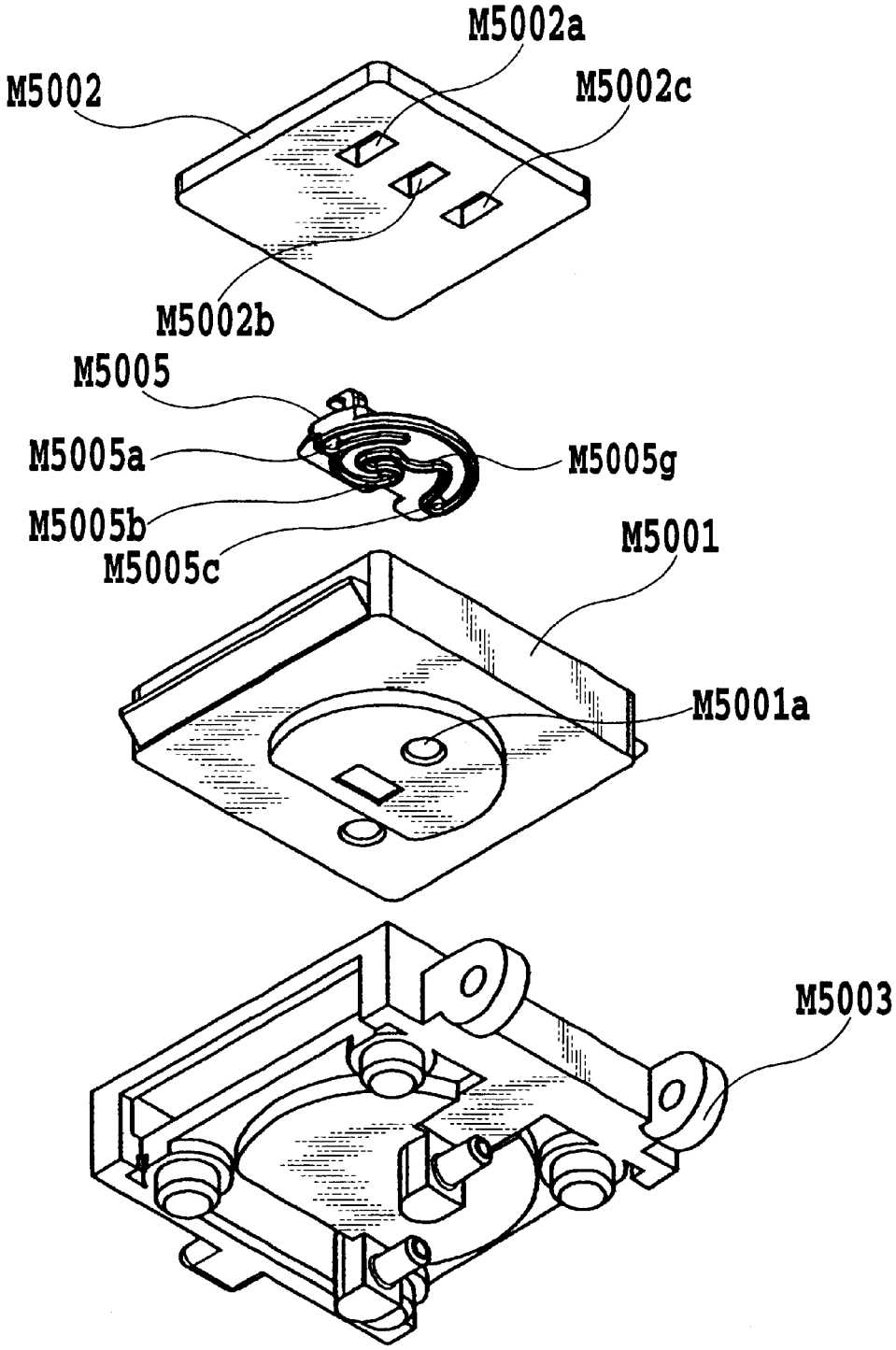
FIG. 15 is an exploded perspective view of the cap unit of FIG. 13 as seen from a bottom side.
Figure 16:
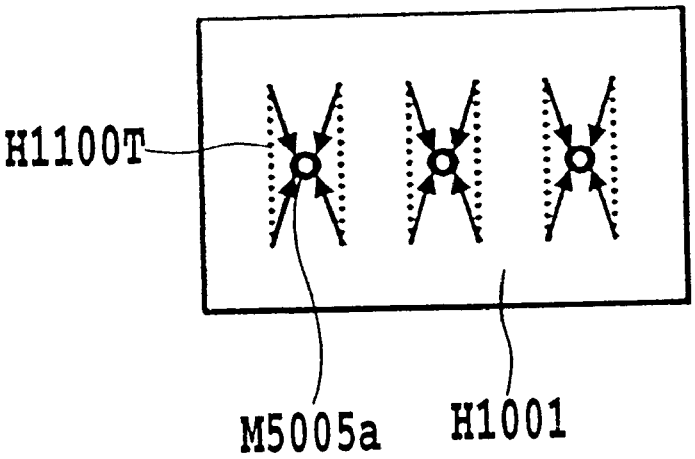
FIG. 16 is a plan view showing a relative positional relation between the suction ports in the retainer member of FIG. 14 and the ejection ports of the print head.
Figure 17:
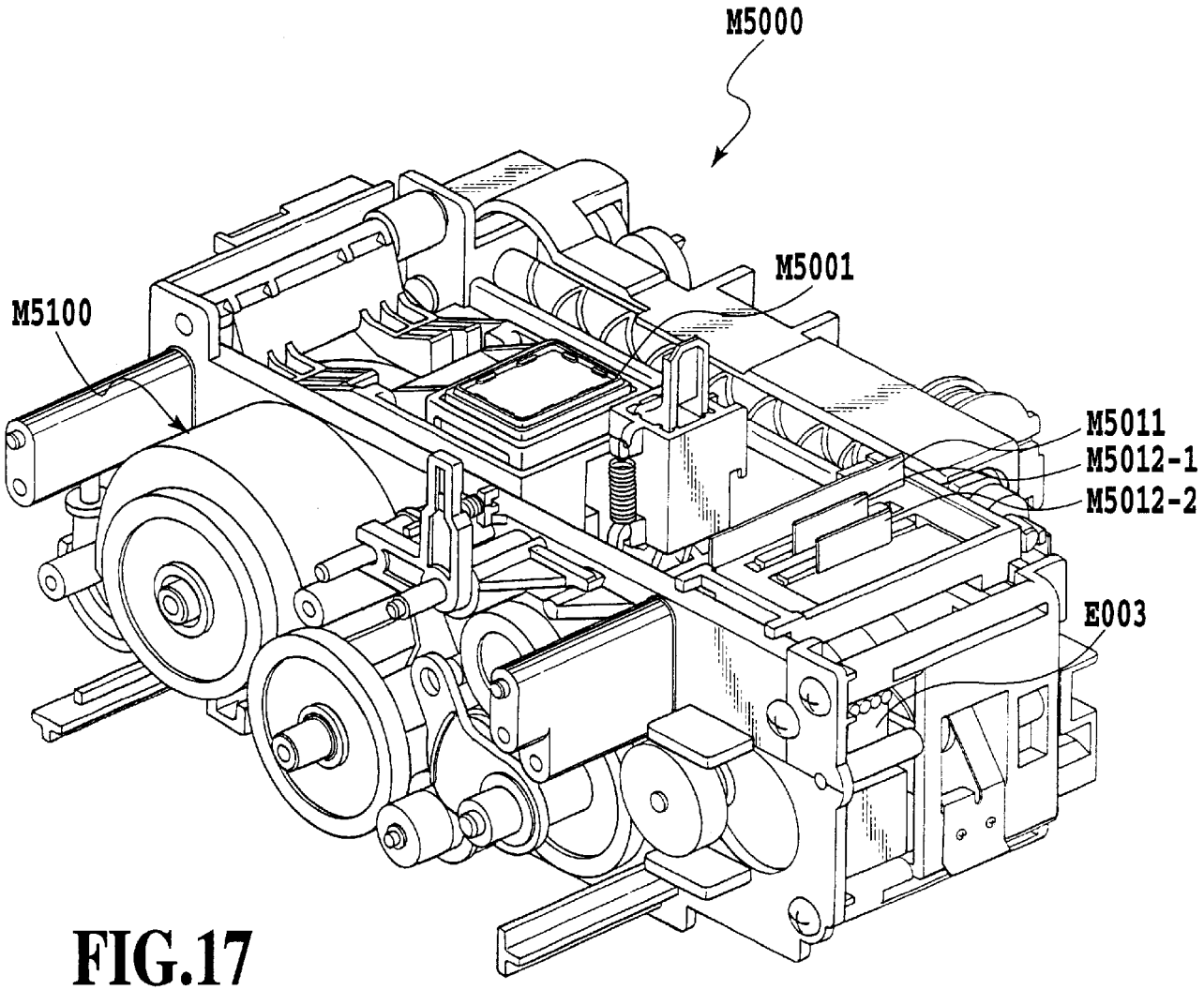
FIG. 17 is a perspective view showing a recovery unit in a conventional ink jet printing apparatus.
Figure 18:
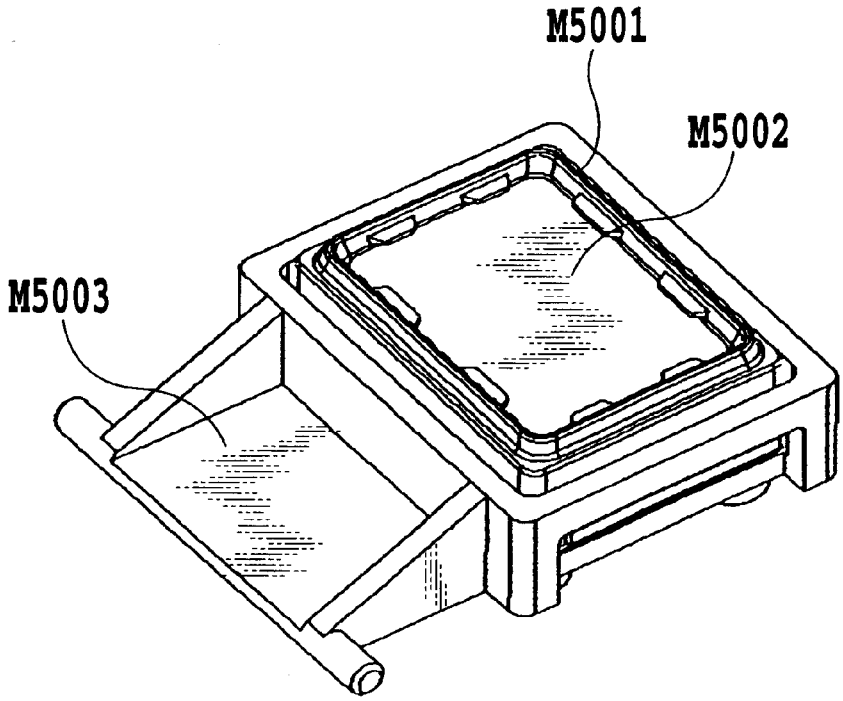
FIG. 18 is a perspective view of a cap unit of prior art.
Figure 19:
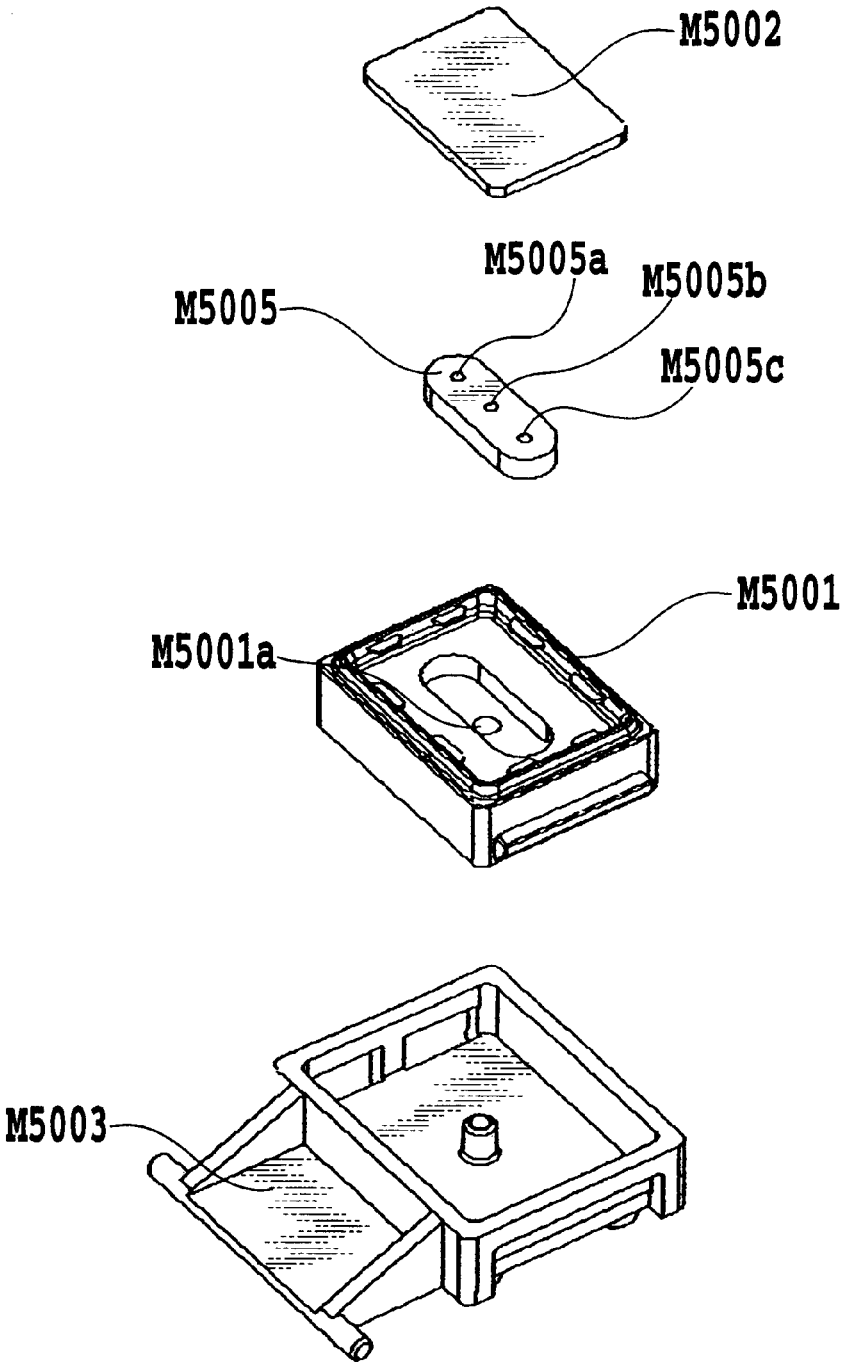
FIG. 19 is an exploded perspective view of the cap unit of the prior art.
Figure 20:
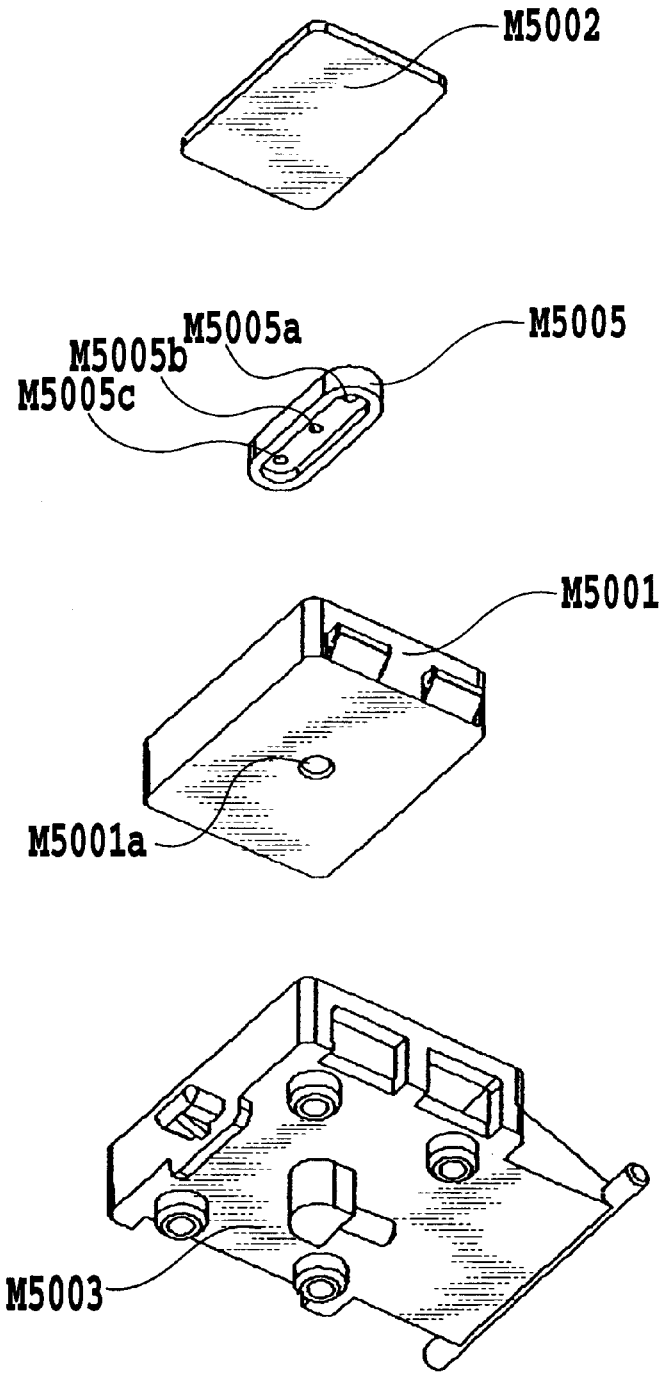
FIG. 20 is an exploded perspective view of the cap unit of the prior art.

FIG. 13 to FIG. 16 illustrate a cap and its associated peripheral constructions provided in a recovery unit of an ink jet printing apparatus in a first embodiment of the invention. FIG. 13 is a perspective view showing a cap holder M5003 incorporating a cap M5001, an ink absorber M5002 and a flow path forming member M5005. FIGS. 14A, B, and *c* shows an exploded perspective view and explanatory vertical side views of the cap holder M5003. FIG. 15 is an exploded perspective view of the cap holder M5003 as seen from an angle different from that of FIG. 14. FIG. 16 is an explanatory diagram showing a relative positional relation between ejection ports H1100T and suction ports of the flow path forming member M5005 provided in the cap M5001 when the cap engages a print element base plate H1100 of the print head H1001. FIG. 16 also shows flows of ink, illustrating how ink flowing out of the ejection ports H1100T during the suction operation reaches the suction ports.

As shown in FIG. 14, when during the suction operation of the recovery unit the pressure in the interior of the cap M5001 becomes negative as the pump M5100 produces a negative pressure, ink flows out of the ejection ports H1100T arranged in the print element base plate H1100 of the print head H1001, passes through the ink absorber M5002 and is discharged from an exhaust port M5001*a* through the suction ports M5005*a*, M5005*b*, M5005*c*. The print head of this embodiment, as shown in FIG. 16, has six parallelly arranged columns of ejection ports, each column made up of a plurality of ejection ports and designed to eject a different kind (color) of ink.

The three suction ports M5005*a*, M5005*b*, M5005*c* formed in the flow path forming member M5005 are each located at a center of each two columns of ejection ports. Hence, the ink drawn out of the ejection ports H1100T by the negative pressure produced in the cap M5001 moves along almost linear paths indicated by arrows running toward the centers of paired ejection port columns and reaches the suction ports M5005*a*, M5005*b*, M5005*c*.

The flow path forming member M5005 engages a recessed portion M5001A formed in a bottom of the cap M5001 and a peripheral portion of the flow path forming member M5005 is held down by eaves portion M5001*b*, M5001*c* protruding from an edge of the recessed portion M5001A toward an inside thereof. The eaves portions M5001*b*, M5001*c* are formed of an elastic member, and the elastic force of the eaves portions causes a rib M5005*g* formed at a bottom of the flow path forming member M5005 to come into intimate contact with an exhaust port forming surface M5001*d* of the recessed portion M5001A. The intimate contact between the rib M5005*g* and the exhaust port forming surface M5001*d* forms three paths running from the suction ports M5005*a*, M5005*b*, M5005*c* to the exhaust port M5001*a*, respectively. These three paths from the suction ports M5005*a*, M5005*b*, M5005*c* to the exhaust port M5001*a* have almost the same cross sections and lengths so that their flow resistances are almost equal.

If a difference is produced among the flow rates of ink drawn in from the suction ports M5005*a*, M5005*b*, M5005*c*, the ink does not flow along the ink paths indicated by the arrows in FIG. 16 but rather flows outside the paired ejection port columns, making it likely for different color inks to get mixed. However, with this embodiment since the three paths have nearly equal flow resistances, the amounts of ink, i.e., the flow speeds of ink, sucked in from the suction ports M5005*a*, M5005*b*, M5005*c* are almost equal. As a result, the ink flows from the ejection port columns into the suction ports M5005*a*, M5005*b*, M5005*c* along the almost linear paths as indicated by the arrow of FIG. 16.

It is therefore possible to minimize the possibility of the ink ejected from the columns of ejection ports flowing out to different ejection port columns along the exhaust port forming surface M5001*d*. This in turn reduces the amounts of ink of different colors remaining near the ejection ports H1100T immediately after the suction operation is completed. Therefore, a problem can be eliminated that when the negative pressure in the print head H1001 produced by the suction operation is removed, ink of different colors may get drawn into the ejection ports H1100T.

Next, an assembly structure of the ink absorber M5002 and the flow path forming member M5005 will be explained.

The ink absorber M5002 has openings M5002*a*, M5002*b*, M5002*c* through which pierce protruding retainer portions M5005*d*, M5005*e*, M5005*f* integrally formed with the flow path forming member M5005 to hold the ink absorber M5002 in pressure contact with the suction ports M5005*a*, M5005*b*, M5005*c*.

That is, as shown in FIG. 14B, the retainer portions, M5005*e*, M5005*f* each consist of a riser portion v almost vertically rising from the upper surface of the flow path forming member M5005 and a clamp portion h bent at right angles at an upper end of the riser portion v to parallelly oppose the suction port forming surface of the flow path forming member M5005, so that the retainer portions are generally shaped like a letter L. The clamp portions h lie above and face the respective suction ports M5005*a*, M5005*b*, M5005*c*. A gap t1 between an underside of each clamp portion h and the suction port forming surface is set slightly smaller than a thickness T of the ink absorber M5002. After the retainer portions M5005*d*, M5005*e*, M5005*f* are inserted into the openings of the ink absorber M5002, an edge of the ink absorber M5002 is fitted under pressure between the clamp portions h and the suction port forming surface. An elastic force of the ink absorber M5002 that was elastically deformed keeps the ink absorber M5002 in pressure contact with the surface of the flow path forming member M5005. In this embodiment, since the clamp portions h are provided at positions opposing the suction ports, the ink absorber is held to the flow path forming member M5005 with a strong force particularly around the suction ports.

With the ink absorber M5002 held under pressure to the suction ports M5005*a*, M5005*b*, M5005*c* as described above, the ink drawn out from the ejection ports H1100T during the ink suction operation by the negative pressure in the interior of the cap M5001 can be quickly introduced into the suction ports M5005*a*, M5005*b*, M5005*c* through the ink absorber M5002. Further, during the suction operation the amount of ink remaining in the cap can be kept comparatively small.

When a so-called evacuation operation is done to discharge the ink from the cap by opening an atmosphere communication port not shown, the open air that flowed in from the atmosphere communication port can be directly introduced into the suction ports M5005*a*, M5005*b*, M5005*c*, thereby completely discharging the ink, if any, remaining in the cap. The open air can reliably push the ink through the ink absorber into the suction ports M5005*a*, M5005*b*, M5005*c*. This action can minimize the amount of ink that may adhere to the ejection ports H1100T and their surrounding areas and flow backward into the ejection ports H1100T.

Because of these effects, the amount of ink that needs to be ejected from the ejection ports H1100T by a preliminary ejection operation that is performed after a blade wiping operation on the nozzle forming surface of the print head does not have to be set as large as in the conventional apparatus to eliminate the mixing of color inks.

Further, in this embodiment, since the retainer portions M5005*d*, M5005*e*, M5005*f* are arranged at such positions that they will not interfere with the ejection ports of the print head, the ink ejection operation is not hindered.

As shown in FIG. 14C, if a distance t2 between the upper surface of the clamp portions h of the retainer portions M5005*d*, M5005*e*, M5005*f* and the ejection port forming surface is set smaller than the thickness of the ink absorber M5002, the retainer portions can be recessed inwardly of the ink absorber, thus more reliably preventing the retainer portions from interfering with the ejection ports of the print head.

Further, if the ink absorber M5002 is formed of a material whose elastic deformation is small, at least the clamp portions of the retainer portions may be made from an elastically deformable member so that the ink absorber can be brought into pressure contact with the ejection port forming surface by the elastic force of the clamp portions.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ejection recovery device in an ink jet printing apparatus which includes a printing head having a plurality of columns of ejection ports to eject different inks and being covered by a single cap, the ejection recovery device comprising:

a pump connected to an exhaust port formed in the cap to generate a predetermined pressure, wherein when the cap covers the ejection ports, the pump causes ink to flow out of the ejection ports and be discharged outside the cap through the exhaust port, and wherein a plurality of suction ports are formed in the cap and a plurality of paths connecting the plurality of suction ports and the exhaust port have almost equal flow resistances.

2. An ejection recovery device in an ink jet printing apparatus as claimed in claim 1, wherein the plurality of paths formed in the cap are so set that flow speeds of ink passing through the plurality of suction ports are almost equal.

3. An ejection recovery device in an ink jet printing apparatus as claimed in claim 1, wherein the plurality of paths are set to have almost equal lengths.

4. An ejection recovery device in an ink jet printing apparatus as claimed in claim 1, wherein the plurality of paths are set to have almost equal cross-sectional areas.

5. An ejection recovery device in an ink jet printing apparatus comprising:

a cap movable toward and away from a print head, the cap being adapted to cover a plurality of ejection ports formed in the print head when it is moved toward the print head; and a pressure generation means connected to an exhaust port formed in the cap to generate a predetermined pressure, wherein when the cap covers the ejection ports, the pressure generation means causes ink to flow out of the ejection ports and be discharged outside the cap through the exhaust port, and wherein a flow path forming member formed with a plurality of suction ports is fixed to the cap by a predetermined fixing means, the flow path forming member is formed with a plurality of paths connecting the plurality of suction ports and the exhaust port, and the plurality of paths from the suction ports to the exhaust port have almost equal flow resistances.

6. An ejection recovery device in an ink jet printing apparatus as claimed in claim 5, wherein the flow path forming member is elastically fixed to an exhaust port forming surface of the cap by the fixing means integrally provided to the cap and having an elasticity.

7. An ejection recovery device in an ink jet printing apparatus as claimed in claim 6, wherein the flow path forming member forms paths in the cap by being combined with the exhaust port forming surface of the cap with which the flow path forming member is brought into intimate contact by an elastic force of the fixing means.

8. An ejection recovery device in an ink jet printing apparatus as claimed in claim 6, wherein the print head has ejection portions, one for each kind of ink, each of the ejection portions having at least one column of ejection ports, wherein when the cap covers the print head, the suction ports of the cap are located near the ejection port columns.

9. An ejection recovery device in an ink jet printing apparatus as claimed in claim 8, wherein the print head has a plurality of columns of ejection ports for each kind of ink, wherein when the cap covers the print head, the suction ports of the cap are located between the ejection port columns.

10. An ejection recovery device in an ink jet printing apparatus comprising:

a cap movable toward and away from a print head, the cap being adapted to cover a plurality of ejection ports formed in the print head when it is moved toward the print head; and a pressure generation means connected to an exhaust port formed in the cap to generate a predetermined pressure, wherein when the cap covers the ejection ports, the pressure generation means causes ink to flow out of the ejection ports and be discharged outside the cap through the exhaust port, and wherein a fixing means is used to fix in the cap a flow path forming member formed with a plurality of suction ports and with a plurality of paths for communicating the plurality of suction ports to the exhaust port.

11. An ink jet printing apparatus comprising:

a printing means having a printing head having a plurality of columns of ejection ports to eject different inks and being covered by a single cap; and an ejection recovery device that performs an ejection recovery operation to keep an ink ejection performance of the ejection ports in good condition, wherein the ejection recovery device includes a pump connected to an exhaust port formed in the cap to generate a predetermined pressure, wherein when the cap covers the ejection ports, the pump causes ink to flow out of the ejection ports and be discharged outside the cap through the exhaust port, and wherein a plurality of suction ports are formed in the cap and a plurality of paths connecting the plurality of suction ports and the exhaust port have almost equal flow resistances.

12. An ink jet printing apparatus comprising:

a cap movable toward and away from a print head, the cap being adapted to cover a plurality of ejection ports formed in the print head when it is moved toward the print head; and a pressure generation means connected to an exhaust port formed in the cap to generate a predetermined pressure, wherein when the cap covers the ejection ports, the pressure generation means causes ink to flow out of the ejection ports and be discharged outside the cap through the exhaust port, and wherein a fixing means is used to fix in the cap a flow path forming member formed with a plurality of suction ports and with a plurality of paths for communicating the plurality of suction ports to the exhaust port.

13. An ejection recovery device in an ink jet printing apparatus as claimed in claim 11, wherein the print head generates bubbles in ink by a thermal energy and ejects ink from the ejection ports by an energy of the bubbles.

14. An ejection recovery device in an ink jet printing apparatus comprising:

a cap movable toward and away from a print head, the cap being adapted to cover a plurality of ejection ports formed in the print head when it is moved toward the print head; and a pressure generation means connected to an exhaust port formed in the cap to generate a predetermined pressure, wherein when the cap covers the ejection ports, the pressure generation means causes ink to flow out of the ejection ports and be discharged outside the cap through the exhaust ports, wherein a flow path forming member having the suction ports is provided in the cap to form a plurality of paths connecting the suction ports and the exhaust port, and wherein the flow path forming member is integrally formed with an engagement means for engaging the ink absorber with the flow path forming member so that the ink absorber capable of absorbing ink can cover the suction ports.

15. An ejection recovery device in an ink jet printing apparatus as claimed in claim 14, wherein the print head has ejection portions, one for each kind of ink, each of the ejection portions having at least one column of ejection ports, wherein a plurality of the suction ports, one for each ejection portion, are provided in the flow path forming member.

16. An ejection recovery device in an ink jet printing apparatus as claimed in claim 14, wherein the engagement means is arranged to avoid an interference with the ejection ports of the print head.

17. An ejection recovery device in an ink jet printing apparatus as claimed in claim 16, wherein the engagement means is provided at a position not opposing the ejection ports of the print head.

18. An ejection recovery device in an ink jet printing apparatus as claimed in claim 14, wherein the engagement means is a bent retainer portion protruding from a suction port forming surface, and the retainer portion is inserted through an insertion hole formed in the ink absorber and one end portion of the retainer portion holds the ink absorber between it and the flow path forming member.

19. An ejection recovery device in an ink jet printing apparatus as claimed in claim 14, wherein the engagement means comprises a riser portion rising from one surface of the flow path forming member and a clamp portion integrally formed at one end of the riser portion and facing the one surface of the flow path forming member.

20. An ejection recovery device in an ink jet printing apparatus as claimed in claim 14, wherein when the suction ports of the flow path forming member and the ink absorber are engaged with each other, at least one of the engagement means and the ink absorber elastically deforms.

21. An ejection recovery device in an ink jet printing apparatus as claimed in claim 14, wherein when the suction ports of the flow path forming member and the ink absorber are engaged with each other, the positions where the engagement means applies an engagement force to the ink absorber matches the suction ports in a planar direction.

22. An ejection recovery device in an ink jet printing apparatus as claimed in claim 14, wherein the flow path forming member is elastically fixed to an exhaust port forming surface of the cap by a fixing member integrally provided to the cap and having an elasticity.

23. An ejection recovery device in an ink jet printing apparatus as claimed in claim 22, wherein the flow path forming member forms paths in the cap by being combined with the exhaust port forming surface of the cap with which the flow path forming member is brought into intimate contact by the elasticity of the fixing means.

24. An ink jet printing apparatus as claimed in claim 14, wherein the print head generates bubbles in ink by a thermal energy and ejects ink from the ejection ports by an energy of the bubbles.

25. An ink jet printing apparatus comprising:

a printing means having a print head formed with a plurality of ejection ports for ejecting ink; and an ejection recovery means that performs an ejection recovery operation to keep an ink ejection performance of the ejection ports in good condition, wherein the ejection recovery means includes: a cap movable toward and away from the print head, the cap being adapted to cover a plurality of ejection ports formed in the print head when it is moved toward the print head; and a pressure generation means connected to an exhaust port formed in the cap to generate a predetermined pressure, wherein when the cap covers the ejection ports, the pressure generation means causes ink to flow out of the ejection ports and be discharged outside the cap through the exhaust port, wherein a flow path forming member having the suction ports is provided in the cap to form a plurality of paths connecting the suction ports and the exhaust port, and wherein the flow path forming member is integrally formed with an engagement means for engaging the ink absorber with the flow path forming member so that the ink absorber capable of absorbing ink can cover the suction ports.

* * * * *

UNITED STATES PATENT AND TRADEMARK OFFICE

CERTIFICATE OF CORRECTION

PATENT NO. : 6,722,757 B2
DATED : April 20, 2004
INVENTOR(S) : Hiroyuki Saito

It is certified that error appears in the above-identified patent and that said Letters Patent is hereby corrected as shown below:

Title page,
Item [56], References Cited, OTHER PUBLICATIONS, "U.S. applciation No. 09/902,758," reference, "applciation" should read -- application --.

Signed and Sealed this

Thirty-first Day of May, 2005

JON W. DUDAS
*Director of the United States Patent and Trademark Office*